US006537716B1

(12) United States Patent
Doi et al.

(10) Patent No.: US 6,537,716 B1
(45) **Date of Patent: *Mar. 25, 2003**

(54) TONER FOR DEVELOPING ELECTROSTATIC IMAGES AND HEAT FIXING METHOD

(75) Inventors: Shinji Doi, Kawasaki (JP); Hirohide Tanikawa, Yokohama (JP); Hiroaki Kawakami, Yokohama (JP); Masatsugu Fujiwara, Yokohama (JP); Tsutomu Onuma, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/760,210

(22) Filed: Dec. 4, 1996

Related U.S. Application Data

(63) Continuation of application No. 08/363,897, filed on Dec. 27, 1994, now abandoned.

(30) Foreign Application Priority Data

Dec. 29, 1993 (JP) ..... 5-352463

(51) Int. Cl.[7] ..... G03G 9/097; G03G 9/087

(52) U.S. Cl. ..... 430/108.23; 430/108.1; 430/108.8; 430/106.1; 430/109.4; 430/120; 430/124

(58) Field of Search ..... 430/110, 109, 430/109.4, 108.8, 108.1, 126, 108.23, 106.1, 124

(56) References Cited

U.S. PATENT DOCUMENTS

| | | | | |
|---|---|---|---|---|
| 2,297,691 | A | 10/1942 | Carlson | |
| 3,941,898 | A | 3/1976 | Sadamatsu et al. | 427/18 |
| 3,959,589 | A | 5/1976 | von Roesgen | 178/69.5 R |
| 4,301,355 | A | 11/1981 | Kimbrough et al. | 219/137 PS |
| 4,386,147 | A | 5/1983 | Seimiya et al. | 430/99 |
| 4,486,524 | A | 12/1984 | Fujisaki et al. | 430/109 |
| 4,499,168 | A | 2/1985 | Mitsuhashi | 430/99 |
| 4,533,614 | A | 8/1985 | Fukumoto et al. | 430/99 |

(List continued on next page.)

FOREIGN PATENT DOCUMENTS

| | | | | |
|---|---|---|---|---|
| DE | 3319955 | | 12/1983 | G03G/9/08 |
| EP | 421 416 | * | 4/1991 | |

(List continued on next page.)

*Primary Examiner*—Christopher Rodee
(74) *Attorney, Agent, or Firm*—Fitzpatrick, Cella, Harper & Scinto

(57) ABSTRACT

A toner for developing electrostatic images is comprised of a binder resin and a wax. The binder resin contains as a primary component a polyester resin having a soft segment. The wax has, in its endothermic peaks at the time of temperature rise and exothermic peaks at the time of temperature drop in the DSC curve measured using a differential scanning calorimeter;

(i) an endothermic onset temperature within the range of from 50° C. to 110° C.;

(ii) at least one endothermic peak P1 within the range of from 70° C. to 130° C. at the time of temperature rise; and (iii) a maximum exothermic peak at the time of temperature drop, within the range of plus-minus 9° C. of the endothermic peak P1.

15 Claims, 4 Drawing Sheets

U.S. PATENT DOCUMENTS

| | | | | | |
|---|---|---|---|---|---|
| 4,578,338 | A | | 3/1986 | Gruber et al. | 430/120 |
| 4,810,612 | A | | 3/1989 | Ueda et al. | 430/109 |
| 4,952,477 | A | * | 8/1990 | Fuller et al. | 430/109 |
| 4,990,424 | A | | 2/1991 | Van Dusen et al. | 430/106.6 |
| 5,124,225 | A | * | 6/1992 | Shibata | 430/110 |
| 5,135,833 | A | | 8/1992 | Matsunaga et al. | 430/110 |
| 5,268,248 | A | | 12/1993 | Tanikawa et al. | 430/106 |
| 5,298,354 | A | | 3/1994 | Matsunaga et al. | 430/99 |
| 5,330,871 | A | | 7/1994 | Tanikawa et al. | 430/110 |
| 5,364,722 | A | | 11/1994 | Tanikawa et al. | 430/110 |
| 5,368,970 | A | * | 11/1994 | Grushkin | 430/110 |
| 5,384,224 | A | | 1/1995 | Tanikawa et al. | 430/106 |
| 5,478,686 | A | * | 12/1995 | Kawakami et al. | 430/109 |

FOREIGN PATENT DOCUMENTS

| | | | | |
|---|---|---|---|---|
| EP | 0471302 | | 2/1992 | G03G/63/20 |
| EP | 531 990 | * | 3/1993 | |
| EP | 0572896 | | 12/1993 | G03G/9/083 |
| JP | 42-23910 | | 11/1967 | |
| JP | 43-24748 | | 10/1968 | |
| JP | 51-23354 | | 2/1976 | |
| JP | 52-3304 | | 1/1977 | |
| JP | 52-3305 | | 1/1977 | |
| JP | 55-6895 | | 2/1980 | |
| JP | 1-109359 | | 4/1980 | |
| JP | 56-16144 | | 2/1981 | |
| JP | 57-52574 | | 3/1982 | |
| JP | 57-52574 | | 11/1982 | |
| JP | 59-7960 | | 1/1984 | |
| JP | 60-217366 | | 10/1985 | |
| JP | 60-252360 | | 12/1985 | |
| JP | 60-252361 | | 12/1985 | |
| JP | 61-94062 | | 5/1986 | |
| JP | 61-138259 | | 6/1986 | |
| JP | 61-273554 | | 12/1986 | |
| JP | 62-14166 | | 1/1987 | |
| JP | 2-79860 | | 3/1990 | |
| JP | 3-50559 | | 3/1991 | |
| JP | 5-197192 | | 8/1993 | |
| JP | 5-249735 | | 9/1993 | |

* cited by examiner

TONER FOR DEVELOPING ELECTROSTATIC IMAGES AND HEAT FIXING METHOD

This application is a continuation of application Ser. No. 08/363,897 filed Dec. 27, 1994, now abandoned.

BACKGROUND OF THE INVENTION

1. Field of the Invention

This invention relates to a toner for developing electrostatic images, suited for heat fixing, used in electrophotography, electrostatic recording and magnetic recording. It also relates to a heat fixing method for fixing the toner by heating.

2. Related Background Art

A number of methods as disclosed in U.S. Pat. No. 2,297,691, Japanese Patent Publications No. 42-23910 and No. 43-24748 and so forth are hitherto known for electrophotography. In general, copies are obtained by forming an electrostatic latent image on a photosensitive member by utilizing a photoconductive material and by various means, subsequently developing the latent image by the use of a toner, and transferring the toner image to a transfer medium such as paper if necessary, followed by fixing by fixing means such as heat, pressure or solvent vapor. The toner that has not transferred to and has remained on the photosensitive member is cleaned by various means, and then the above process is repeated.

In recent years, such copying apparatus have begun to be used not only as office copying machines for merely taking copies from originals as is done commonly, but also as printers which are output means of computers, or in the field of personal copy making device.

Under such circumstances, the apparatus are severely sought to be made more small-sized and light-weight, and also to be made more high-speed and more highly reliable. Thus, machines are now constructed with simpler constituents in various points. As a result, toners are required to have a higher performance, and it has become impossible to accomplish superior machines unless improvements in performance of toners can be achieved.

Various methods or devices have been developed in relation to the step of fixing a toner image to a sheet such as paper. For example, the pressure heat system using a heat roller and the heat fixing system where a transfer medium is brought into close contact with a pressure member interposing a film between them are available.

Such heating systems using a heat roller or a film are methods of carrying out fixing by causing the toner image surface of an image-receiving sheet to pass the surface of a heat roller whose surface is formed of a material having releasability to toner (toner-releasing characteristics) while the former is brought into contact with the latter. Since in this method the surface of the heat roller comes into contact with the toner image of the image-receiving sheet under application of a pressure, a very good thermal efficiency can be achieved when the toner image is melt-adhered onto the image-receiving sheet, so that fixing can be carried out rapidly. Thus, this method is very effective in electrophotographic copying machines. In these methods, however, since the surface of the heat roller or film comes into contact with the toner image in a molten state, part of the toner image may adhere and transfer to the surface of the fixing roller or film, which is re-transferred to the subsequent image-receiving sheet to cause what is called the offset phenomenon, resulting in a contamination of the image-receiving sheet. Thus, it is considered to be one of essential conditions in the heat fixing system that no toner adheres to the surface of the heat fixing roller.

For the purpose of not causing the toner to adhere to the surface of a fixing roller, measures have been hitherto taken that the roller surface is formed of a material such as silicone rubber or fluorine resin, having an excellent releasability to toner, and, in order to prevent offset and to prevent fatigue of the roller surface, its surface is further covered with a thin film formed using a fluid having a good releasability as exemplified by silicone oil. Although this method is very effective from a viewpoint of inhibiting the offset of toner, it requires a device for feeding an anti-offset fluid, and hence has the problem that the fixing device becomes complicated.

This is in the opposite direction to the demand for small size and light weight. In some instances, the silicone oil is evaporated by heat to contaminate the interior of the machine. Now, based on the idea that the fluid for preventing offset should be fed from the the inside of a toner without the use of any apparatus for feeding silicone oil, a method has been proposed in which a release agent such as a low-molecular weight polyethylene or a low-molecular weight polypropylene is added in the toner. Addition of such a release agent in a large quantity in order to attain a sufficient effect may cause filming to the photosensitive member or cause a contamination of the surface of a toner carrying member such as a carrier or a sleeve, so that toner images may be deteriorated to raise a problem in practical use. Thus the release agent is added to the toner in such a small amount that may not cause the deterioration of toner images, where a releasing oil is fed in a little amount and a device for cleaning the toner that may cause offset by using a member such as a web of a wind-up type is used together.

However, taking account of the recent demand for small size, light weight and high reliability, it is necessary and preferred to remove even such a supplementary device. Accordingly, no countermeasure can be completely taken unless the fixing performance and anti-offset of the toner are further improved. It is difficult to achieve the improvement unless binder resins and release agents for toners are further improved.

Incorporating a wax into toners as a release agent is disclosed, for example, in Japanese Patent Publications No. 52-3304, No. 52-3305 and No. 57-52574.

Techniques for incorporating waxes are also disclosed in Japanese Patent Applications Laid-open No. 3-50559, No. 2-79860, No. 1-109359, No. 62-14166, No. 61-273554, No. 61-94062, No. 61-138259, No. 60-252361, No. 60-252360 and No. 60-217366.

Waxes are used to improve anti-offset properties of toners in low-temperature fixing or high-temperature fixing or to improve fixing performance in low-temperature fixing. However, while these performances are improved, blocking resistance may become poor, developing performance may become poor when toner is exposed to heat caused by an in-machine temperature rise, or wax blooming may occur when toners are left for a long period of time, to make developing performance poor.

None of conventional toners have satisfied all requirements of these aspects, and have caused some problem. For example, some have good high-temperature anti-offset properties but have not so definitely good low-temperature anti-offset properties, some have good low-temperature anti-offset properties and low-temperature fixing performance but have a little poor blocking resistance to undesirably cause a lowering of developing performance due to in-machine temperature rise, or some can not achieve anti-offset properties in high-temperature fixing and low-temperature fixing at the same time.

Toners containing a low-molecular weight polypropylene (e.g., VISCOL 550P, 660P, etc., produced by Sanyo Chemical Industries Co., Ltd.) are commercially available, but it is sought to provide toners more improved in low-temperature anti-offset properties and also improved in fixing performance.

In order to improve fixing performance of toners, binder resins contained in toners are also improved. When only the fixing performance is taken into account, the binder resins are required to have lower molecular weight and glass transition point. This, however, causes a lowering of high-temperature anti-offset properties and blocking resistance.

To overcome such disadvantages, Japanese Patent Publication No. 51-23354, for example, proposes a toner in which a cross-linked polymer (a vinyl-type polymer) is used as a binder resin, Japanese Patent publication No. 55-6895 proposes a toner containing a binder resin having $\alpha,\beta$-unsaturated ethylene monomers as component units and made to have a broader molecular weight distribution of 3.5 to 40 in the ratio of weight average molecular weight to number average molecular weight, and Japanese Patent Application Laid-open No. 56-16144 proposes a toner containing a binder resin having in a viny polymer a peak in each of its low-molecular weight region and high-molecular weight region on a GPC chromatogram. It is true that these toners proposed have achieved both high-temperature anti-offset properties and fixing performance at the same time to a certain extent, but further improvements are sought.

In place of these vinyl type, addition polymerization type binder resins, condensation polymerization type polyesters have been proposed in the past.

For example, Japanese Patent Application Laid-open No. 59-7960 discloses a toner comprising an improved specific polyester as a binder resin. This has certainly achieved a low-temperature fixing performance superior to vinyl type resins, but its release component wax has a poor dispersibility to raise a problem of poor anti-offset properties.

Japanese Patent Application Laid-open No. 5-197192 also discloses a toner containing a hydrocarbon wax having specific thermal properties. This toner containing a hydrocarbon wax having specific thermal properties can impart preferable thermal properties to toners and hence have superior fixing performance, anti-offset properties and blocking resistance in low-temperature fixing. However, in order to make more effective the hydrocarbon wax having specific thermal properties, it is desired for the hydrocarbon wax to have a much better dispersibility in the binder resin, and there is room for further improvement.

Japanese Patent Application Laid-open No. 5-249735 discloses a toner containing a (styrene type) binder resin having a functional group, and a hydrocarbon wax, where the elasticity modulus and thermal properties of the toner are defined so that its fixing performance, anti-offset properties and blocking resistance can be improved.

There, however, is a limit in the improvement of performances (in particular, fixing performance) if it relies on only these known techniques. In order to well bring out the performance of polyesters which is matched to low-temperature fixing, it is sought to make more improvements while maintaining other toner performances such as blocking resistance and developing performance.

SUMMARY OF THE INVENTION

An object of the present invention is to provide a toner for developing an electrostatic image, having solved the problems as discussed above, and a method for fixing such a toner by heating.

Another object of the present invention is to provide a toner having superior fixing performance and anti-offset properties in low-temperature fixing, and a method for fixing such a toner by heating.

Still another object of the present invention is to provide a toner having superior anti-offset properties in high-temperature fixing, and a method for fixing such a toner by heating.

A further object of the present invention is to provide a toner having a superior blocking resistance, causing no deterioration of developing performance even when left for a long period of time, and a method for fixing such a toner by heating.

A still further object of the present invention is to provide a toner having a superior durability against in-machine temperature rise, and a method for fixing such a toner by heating.

A still further object of the present invention is to provide a toner for developing an electrostatic image, having a superior rise of charging in high-temperature fixing, and a method for fixing such a toner by heating.

To achieve the above objects, the present invention provides a toner for developing electrostatic images, comprising a binder resin and a wax, wherein;

the binder resin contains as a primary component a polyester resin having a soft segment; and the wax has, in its endothermic peaks at the time of temperature rise and exothermic peaks at the time of temperature drop in the DSC curve measured using a differential scanning calorimeter;

(i) an endothermic onset temperature within the range of from 50° C. to 110° C.;

(ii) at least one endothermic peak P1 within the range of from 70° C. to 130° C. at the time of temperature rise; and (iii) a maximum exothermic peak at the time of temperature drop, within the range of plus-minus 9° C. of the endothermic peak P1.

The present invention also provides a heat fixing method comprising fixing a toner image on a recording medium by a heat fixing means, wherein;

the toner image is formed by a toner having at least a binder resin and a wax;

the binder resin contains as a primary component a polyester resin having a soft segment; and the wax has, in its endothermic peaks at the time of temperature rise and exothermic peaks at the time of temperature drop in the DSC curve measured using a differential scanning calorimeter;

(i) an endothermic onset temperature within the range of from 50° C. to 110° C.;

(ii) at least one endothermic peak P1 within the range of from 70° C. to 130° C. at the time of temperature rise; and (iii) a maximum exothermic peak at the time of temperature drop, within the range of plus-minus 9° C. of the endothermic peak P1.

DESCRIPTION OF THE PREFERRED EMBODIMENTS

Figure 1:
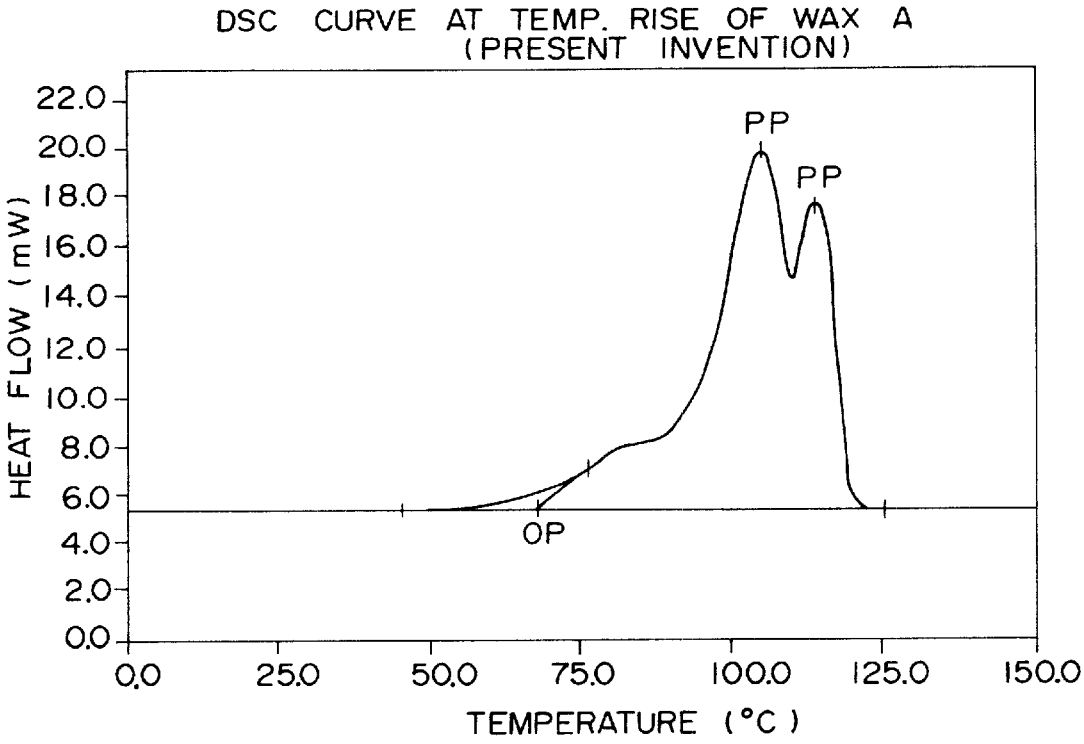
FIG. 1 illustrates the DSC curve at the time of temperature rise, of wax A used in Example.

The present inventors made extensive studies on improvements in fixing performance, anti-offset properties, blocking resistance and developing performance of toners. As a result, they have discovered that, when a polyester resin having a soft segment is used as a primary component of a binder resin of a toner and a sharp-melting wax having specific thermal properties is used as a wax that functions as a release agent of the toner, the soft segment possessed by the polyester resin seems to act so as to improve the dispersibility in the polyester resin, and also, since the polyester resin having such a soft segment is a primary component of the binder resin, the wax component having specific thermal properties can be uniformly dispersed into the binder resin of the toner, whereby the toner can have better low-temperature fixing performance and better developing performance while maintaining anti-offset properties and blocking resistance in low-temperature to high-temperature fixing. They have thus accomplished the present invention.

The toner of the present invention is comprised of at least a binder resin and a wax.

The wax used in the present invention has, in its endothermic peaks at the time of temperature rise and exothermic peaks at the time of temperature drop in the DSC curve measured using a differential scanning calorimeter, (i) an endothermic onset temperature within the range of from 50° C. to 110° C., (ii) at least one endothermic peak P1 within the range of from 70° C. to 130° C. at the time of temperature rise, and (iii) a maximum exothermic peak at the time of temperature drop, within the range of plus-minus 9° C. of the endothermic peak P1.

At the time of temperature rise, changes in condition of wax when heated can be seen, and endothermic peaks ascribable to phase transition and melting of a wax component can be observed. The wax can satisfy not only blocking resistance and low-temperature fixing performance but also developability, when the endothermic onset temperature is within the range of from 50° C. to 110° C., preferably from 50° C. to 90° C., and more preferably from 60° C. to 90° C.

If this endothermic onset temperature is lower than 50° C., the temperature at which the wax undergoes a change becomes excessively low to make the toner have a poor blocking resistance or a poor developability at the time of temperature rise. Moreover, since the polyester used in the present invention, which will be detailed later, has in its skeleton a soft segment capable of imparting plasticity to the toner, the blocking resistance of the toner may particularly remarkably become poor if the endothermic onset temperature is lower than 50° C. If endothermic onset temperature is higher than 110° C., the temperature at which the wax undergoes a change becomes excessively high to make it impossible to achieve a satisfactory fixing performance.

Good fixing performance and anti-offset properties can be satisfied when the endothermic peak is present within the range of from 70° C. to 130° C., preferably within the range of from 70° C. to 120° C., more preferably from 95° C. to 120° C., and particularly preferably from 97° C. to 115° C.

If the peak temperature is present only at a temperature lower than 70° C., the melting temperature of the wax becomes excessively low to make it impossible to achieve a satisfactory high-temperature anti-offset properties. If the peak temperature is present only in the temperature range higher than 130° C., the melting temperature of the wax becomes excessively high to make it impossible to achieve a satisfactory low-temperature anti-offset properties and low-temperature fixing performance.

Here, if the peak at a temperature lower than 70° C. is a maximum peak, the wax exhibits the same behavior as in the case where the peak is present only within this range, and hence, a peak may be present within this range. In such a case, however, the peak must be smaller than the peak present within the range of 70° C. to 130° C.

At the time of temperature drop, changes in condition of wax when cooled and condition thereof at room temperature can be seen, and exothermic peaks ascribable to solidification, crystallization and phase transition of wax can be observed. The maximum exothermic peak at the time of temperature drop is an exothermic peak ascribable to solidification and crystallization of the wax. The fact that an endothermic peak ascribable to the melting at the time of temperature rise is present at a temperature close to this exothermic peak temperature indicates that the wax have a more homogeneous structure and also a sharper molecular weight distribution, and the difference between them may be within 9° C., preferably within 7° C., and more preferably within 5° C. Making this difference smaller can provide a sharp-melting wax, which is hard at low temperatures, quickly melts when melted, and also greatly causes a decrease in melt viscosity, so that it becomes possible to well balance the developing performance, blocking resistance, fixing performance and anti-offset properties.

The maximum exothermic peak may be present in the region of temperatures of from 85° C. to 115° C., and preferably from 90° C. to 110° C.

The DSC measurement of wax is carried out to measure the exchange of heat of the wax to observe its behavior. Hence, in view of the principle of measurement, the measurement must be carried out using a differential scanning calorimeter of a highly precise, inner heat input compensation type. For example, it is possible to use DSC-7, manufactured by Perkin Elmer Co.

The measurement is carried out according to ASTM D3418-82. The DSC curve used in the present invention is the one measured when temperature is once raised to remove a previous history and thereafter the temperature is dropped or raised at a rate of 10° C./min in the range of temperatures of from 0 to 200° C. Each temperature is defined as follows:

Endothermic onset temperature:

The lowest temperature of temperatures where the differential value of the DSC curve at the time of temperature rise becomes greatest.

Endothermic peak temperature:

A peak top temperature of endothermic peaks at the time of temperature rise.

Exothermic peak temperature:

A peak top temperature of a maximum exothermic peak at the time of temperature drop.

The wax used in the present invention is obtained using the following waxes as bases and by optionally fractionating them. Such waxes used as bases include paraffin wax and derivatives thereof, montan wax and derivatives thereof, microcrystalline wax and derivatives thereof, Fischer-Tropsch wax and derivatives thereof, and polyolefin wax and derivatives thereof. The derivatives may include oxides, block copolymers with vinyl monomers, and graft-modified products.

As other waxes usable as bases, it is also possible to use higher aliphatic alcohols, higher fatty acids and esterified product s thereof, higher fatty acid amides, ketone waxes, hardened castor oil and derivatives thereof, as well as vegetable waxes such as carnauba wax and derivatives thereof, animal waxes, mineral waxes and petrolatum.

In particular, waxes preferably usable are synthetic hydrocarbon waxes synthesized by reacting carbon monoxide with hydrogen in the presence of a metal oxide type catalyst, as exemplified by hydrocarbons having about several hundred carbon atoms (what is called Fischer-Tropsch wax) obtained by the Synthol method, the Hydrocol process (making use of a fluidized catalyst bed), or the Arge process (making use of a fixed catalyst bed) in which waxy hydrocarbons can be obtained in the majority; and polyolefins such as polyethylene obtained by polymerization in the presence of a Ziegler catalyst, and by-products from the polymerization.

Using these waxes as bases, waxes may be fractionated according to molecular weight by press sweating, solvent fractionation, recrystallization, vacuum distillation, ultracritical gas extraction or molten liquid crystallization. The waxes thus obtained may be used in the present invention. Of these processes, it is particularly preferred to use the ultracritical gas extraction (in this process, since the solvent is in the sate of gas, the solvent can be separated and recovered easely and molecular weight fractionated products can be obtained according to purpose) or the vacuum distillation, and a process in which distillates obtained from these processes are subjected to molten liquid crystallization to filtrate crystals.

That is, those having any desired molecular weight distribution can be obtained, e.g., those from which low-molecular weight components have been removed and those from which low-molecular weight components have been extracted, by these processes, or those obtained by further removing low-molecular weight components from these. After fractionation, the products may be oxidized or graft-modified.

In the present invention, preferable molecular weights of the wax may vary depending on its structure, and can not necessarily be defined absolutely. The wax may preferably have, in molecular weight distribution measured by GPC, a number average molecular weight of approximately from 300 to 1,500. For example, in the case of hydrocarbon waxes such as polyolefines, they may have a number average molecular weight (Mn) preferably ranging from 300 to 1,500, more preferably from 400 to 1,200, and still more preferably from 600 to 1,000, a weight average molecular weight (Mw) of from 500 to 6,000, preferably from 600 to 3,500, and more preferably from 800 to 2,000, and Mw/Mn of not more than 3, preferably not more than 2.5, and more preferably not more than 2.0.

In the present invention, the molecular weight distribution of the release agent can be measured by viscometry, ebullioscopy, cryoscopy, vapor-pressure depressing, end-group analysis, high-temperature gas chromatography or gel permeation chromatography (GPC). In the case when it can be measured by GPC, it is measured under the following conditions.

GPC measurement conditions

Apparatus: GPC-150 (Waters Co.)

Columns: GMH-HT 30 cm, two series (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

When molecular weight of the sample is calculated, a molecular weight calibration curve prepared from a monodisperse polystyrene standard sample is used. Further, it is calculated by making a conversion corresponding to the structural formula of the wax according to a conversion formula derived from the Mark-Houwink viscosity formula.

DSC characteristics can be substituted for physical properties resulting from preferable molecular weight distributions for each structure. If low-molecular weight components are present in excess for each structure, the onset temperature of an endothermic peak becomes lower than 50° C. On the other hand, if high-molecular weight components are present in excess for each structure, the peak top temperature of a maximum endothermic peak becomes higher than 130° C. Then, the wax may become less effective or ill effects are brought about.

With regard to other properties, the wax may preferably have at 25° C. a density of 0.95 g/cm$^3$ or more and a penetration of preferably 1.5 ($10^{-1}$ mm) or less, and more preferably 1.0 ($10^{-1}$ mm) or less. If they are outside these ranges, the toner is liable to undergo changes during low-temperature fixing, tending to result in poor storage stability and developing performance.

The wax may have a melt viscosity at 140° C., of 100 cp or less, preferably 50 cp or less, and more preferably 20 cp or less. If it has a melt viscosity higher than 100 cp, plasticity and releasability may become poor to affect fixing performance and anti-offset properties.

The wax may also preferably have a softening point of 130° C. or below, and particularly preferably 120° C. or below. If higher than 130° C., the temperature at which the releasability is effectively exhibited becomes so high as to affect the anti-offset properties.

The wax may be used in an amount of 20 parts by weight or less, and is particularly effectively usable in an amount of from 0.5 to 10 parts by weight, based on 100 parts by weight of the binder resin.

The penetration of waxes in the present invention is a value measured according to JIS K-2207. Stated specifically, it is a numerical value corresponding to the depth of penetration measured when a needle having a diameter of about 1 mm and a conical tip with a vertical angle of 9° is penetrated into a sample under a given load, and expressed in units of 0.1 mm. Test conditions in the present invention are as follows: Sample temperature: 25° C.; load: 100 g; and penetration time: 5 seconds.

The melt viscosity is a value measured using a Brookfield viscometer. Test conditions are as follows: temperature: 140° C., slip speed: 1.32 rpm; and sample: 10 ml. The density and the softening point are values measured by the ring and ball method at 25° C. according to JIS K6760 and JIS K2207, respectively.

The wax used in the present invention, having the above specific thermal properties, sharp melts when melted and hence is difficult to disperse in the binder resin. The wax having such specific thermal properties is required to have a better dispersibility in binder resins especially in the case of toners which are required to have a higher durability which are used while being supplied. However, since the binder resin used in the present invention comprises as a primary component the polyester resin having a soft segment, the wax having such thermal properties corresponding to the endothermic properties has, though the mechanism is unknown, a good dispersibility in the polyester having a soft segment in its skeleton, and hence it has become possible to achieve developing performance, blocking resistance and anti-offset properties at much higher levels.

In the present invention, the primary component in the binder resin means a resin having the largest content among components contained in the binder resin.

In the present invention, the polyester resin having a soft segment specifically refers to a polyester resin into the polyester skeleton of which the soft segment (i.e., an alkyl group or alkenyl group having 5 to 30 carbon atoms) has been introduced in a branched form. Such a polyester resin can be obtained by synthesis carried out using as a monomer component an aliphatic dicarboxylic acid substituted with the soft segment or an aliphatic diol substituted with the soft segment.

In the polyester resin having a soft segment, used in the present invention, when the soft segment substituent is imparted to the dicarboxylic acid, the aliphatic dicarboxylic acid substituted with a soft segment may be incorporated preferably in a content of from 2 to 30 mol %, and more preferably from 5 to 20 mol %, based on the whole monomer components. When the soft segment substituent is imparted to the aliphatic diol, the aliphatic diol substituted with a soft segment may be incorporated preferably in a content of from 2 to 30 mol %, and more preferably from 5 to 20 mol %, based on the whole monomer components. When the soft segment substituent is imparted to both the aliphatic dicarboxylic acid and the aliphatic diol, the aliphatic dicarboxylic acid substituted with a soft segment and the aliphatic diol substituted with a soft segment may be incorporated preferably in a content of from 2 to 30 mol %, and more preferably from 5 to 20 mol %, in total, based on the whole monomer components. If the monomer(s) substituted with a soft segment is only in a content of less than 2 mol %, the toner may have an unsatisfactory low-temperature fixing performance, and if more than 30 mol %, inferior blocking resistance and inferior developing performance at the time of temperature rise.

The monomer composition of the polyester used in the present invention is as shown below.

As a dibasic carboxylic acid component may be included, for example, aromatic dicarboxylic acids or anhydrides thereof such as phthalic acid, terephthalic acid, isophthalic acid and phthalic anhydride, and lower alkyl esters thereof; aliphatic dicarboxylic acids such as succinic acid, adipic acid, sebasic acid and azelaic acid or anhydrides thereof and lower alkyl esters thereof; aliphatic unsaturated dicarboxylic acids such as fumaric acid, maleic acid, citraconic acid and itaconic acid or anhydrides thereof and lower alkyl esters thereof; and also aliphatic dicarboxylic acids or anhydrides thereof and lower alkyl esters thereof substituted with a soft segment (an alkyl group or alkenyl group having 5 to 30 carbon atoms) which is the component essential to the polyester used in the present invention.

The aliphatic dicarboxylic acids substituted with the soft segment may specifically include n-dodecenylsuccinic acid, n-dodecylsuccinic acid, indodecenylsuccinic acid, indodecylsuccinic acid, n-octenylsuccinic acid and n-ocytylsuccinic acid. In particular, n-dodecenylsuccinic acid and n-dodecylsuccinic acid are preferred.

As a dihydric alcohol component, it may include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol represented by the following formula (A).

Formula (A)

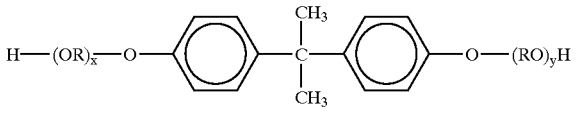

wherein R represents an ethylene group or a propylene group, x and y are each an integer of 0 or more, and an average value of x+y is 0 to 10;

and derivatives thereof, and a diol represented by the following formula (B).

Formula (B)

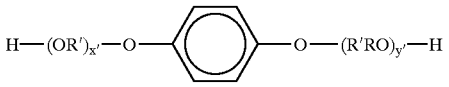

wherein R' represents

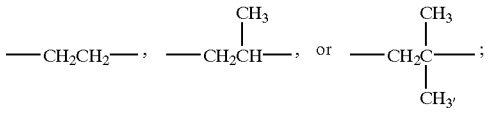

x and y are each an integer of 0 or more, and an average value of x+y is 0 to 10.

It is also possible to use a liphatic diols substituted with a soft segment (an alkyl group or alkenyl group having 5 to 30 carbon atoms) which is the component essential to the polyester used in the present invention, as exemplified by n-dodecenyl ethylene glycol-and n-dodecenyl triethylene glycol.

As a tribasic or higher, polybasic carboxylic acid component in the present invention, it may include polybasic carboxylic acids and derivatives thereof as exemplified by trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Empol trimer acid, or anhydrides and lower alkyl esters of these; and a tetracarboxylic acid re presented by the following formula (C).

Formula (C)

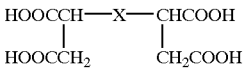

wherein X represents an alkylene group or alkenylene group having 5 to 30 carbon atoms having at least one side chain having 3 or more carbon atoms, and anhydrides or lower alkyl esters thereof.

As a trihydric or higher, polyhydric alcohol component, it may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The polybasic or polyhydric monomer component such as the tribasic or higher, polycarboxylic acid component and the polyhydric alcohol component, used to form a non-linear polyester resin, may preferably be used in an amount of from 5 to 60 mol %, and more preferably from 7 to 30 mol % of the whole components.

Use of this trihydric or -basic or higher, polyhydric or -basic component in an amount less than 5 mol % may cause a deterioration of high-temperature anti-offset properties, and use thereof in an amount more than 60 mol % may damage low-temperature fixing performance. However, it may be used in an amount less than 5 mol % when an auxiliary means for applying a releasability improver such as silicone oil is given to a fixing roller.

In the present invention, the binder resin is comprised of the polyester resin, and this polyester resin may be used in a combination of a linear polyester resin synthesized using the dibasic carboxylic acid component and the dihydric alcohol component and a non-linear polyester resin synthesized further using the trihydric or -basic or higher, polycarboxylic acid or polyhydric alcohol component. This is more preferable in view of achieving both the fixing performance and the anti-offset properties at higher levels.

This non-linear polyester resin functions especially to provide anti-offset properties and the linear polyester resin functions to improve fixing performance. These non-linear polyester resin and linear polyester resin may preferably be mixed in the proportion of from 5:95 to 60:40, preferably from 10:90 to 50:50, more preferably from 10:90 to 40:60.

If the proportion of the non-linear polyester resin is smaller than 5%, high-temperature anti-offset properties may become poor. If it is larger than 50%, low-temperature fixing performance may become poor.

The use of these non-linear polyester resin and linear polyester resin in combination tends to cause lowering of anti-offset properties because of the influence of the linear polyester resin. Accordingly, these polyester resin may preferably be made to undergo cross-linking reaction at the time of melt kneading so that the anti-offset properties can be improved while maintaining a good fixing performance, to prevent the anti-offset properties from lowering when the non-linear polyester resin and the linear polyester resin are used in combination.

As materials that can allow these resins to undergo cross-linking reaction at the time of melt kneading, it is possible to use inorganic or organic metal compounds such as metal salts, metal complexes and organic metal salts.

This cross-linking reaction at the time of melt kneading takes place mainly on the non-linear polyester resin having many molecular-chain terminals, on account of coordinate bonds or ionic bonds of functional groups such as carboxyl groups or hydroxyl groups at the terminals, which bonds are formed through metals in the metal compounds. On the linear polyester resin having less terminals, terminals come to appear when molecular chains are cut at the time of melt kneading, and the functional groups thus formed at the terminals combine with the metal compounds to cause the cross-linking reaction to some extent.

Accordingly, when in the present invention the non-linear polyester resin and the linear polyester resin are used in combination in the binder resin, and further, the polyester resin is metal-crosslinked at the time of melt kneading by the use of the metal compound, the binder resin may preferably have an acid value of 10 mg•KOH/g or below, more preferably 9 mg•KOH/g or below, and particularly 6 mg•KOH/g or below. If this acid value of the binder resin is greater than 10 mg•KOH/g, the cross-linking with metals used may excessively proceed to cause a lowering of fixing performance.

In the present invention, the binder resin of the toner should contain the polyester resin having the soft segment, as a primary component (i.e., as a resin having the largest content in the binder resin), preferably in a content of not less than 50% by weight, and more preferably not less than 70% by weight, based on the weight of the binder resin. This is preferable in order to well disperse in the binder resin the wax having the specific thermal properties previously described.

In the present invention, as the binder resin of the toner, a secondary component that can be used in combination with the polyester resin having the soft segment may include styrene resins such as styrene polymer, a styrene-acrylate copolymer, a styrene-butadiene copolymer, a styrene-isoprene copolymer and a styrene-acrylonitrile-indene copolymer, acrylic resin, methacrylic resin, silicone resin, polyester, polyurethane, polyamide resin, furan resin, epoxy resin, xylene resin, polyvinyl butyral, terpene resin, chromaindene resin and petroleum resins. Particularly, taking account of the dispersibility in the binder resin of the wax having the specific thermal properties, a polyester resin is also preferable as the secondary component in combination with the primary component polyester resin having the soft segment.

This is because the wax having the specific thermal properties can be well dispersed in the polyester resin having the soft segment, and the polyester resin having the soft segment has good compatibility with the resin used in combination when it is a polyester resin, and hence the dispersibility of the wax having the specific thermal properties in the whole binder resin can be more improved.

In the foregoing description, it makes reference to the binder resin in which the primary component polyester resin having the soft segment is used in combination with the secondary component other binder resin. When the polyester resin having the soft segment is used alone as the binder resin, the wax having the specific thermal properties has of course a high dispersibility in the binder resin.

In the present invention, taking account of an influence of humidity, the polyester resin having the soft segment may also preferably have an acid value of 10 mg•KOH/g or below, more preferably 9 mg•KOH/g or below, and particularly 6 mg•KOH/g or below.

The polyester resin having the soft segment tends to be affected by heat and humidity and hence tends to cause deterioration of the toner especially in an environment of high temperature and high humidity. In the case where this polyester resin has an acid value larger than 10 mg•KOH/g, it is more liable to be affected by humidity and hence tends to cause a lowering of chargeability of the toner and a decrease in image density or an increase in fog.

Taking account of environmental dependence of the toner, the whole polyester resins used in the present invention may also preferably have an acid value of 10 mg•KOH/g or below, more preferably 9 mg•KOH/g or below, and particularly 6 mg•KOH/g or below.

If the whole polyester resins have an acid value larger than 10 mg•KOH/g, the toner tends to be affected by humidity especially in an environment of high humidity to cause a great leak of charges, resulting in a lowering of charging performance of the toner.

On the other hand, the use of a binder resin having a low acid value is preferred since the toner does not tend to be affected by humidity to bring about an improvement in environmental properties. However, a toner using such a binder resin with a low acid value tends to cause a poor rise of charging of the toner because of a low chargeability of the resin itself (in particular, in negative charging). When, however, the polyester resin is used as the binder resin, the rise of charging is good first of all because of the polyester having ester bonds as its own structural features, even when the terminal carboxyl groups that manifest the acid value become small, so that a high image density can be obtained at the initial and further stages. This is an effect inherent in the polyester resin.

The acid value of this polyester resin can be made lower by, for example, a method in which unreacted carboxyl groups in the polyester resin is decreased by accelerating ester reaction. Stated specifically, as will be detailed in Examples set out later, it can be decreased by controlling pressure in a reaction vessel used when polyester resin is synthesized.

The toner of the present invention may contain a charge control agent.

As an agent for controlling the toner to be negatively chargeable, for example, organic metal complex salts and chelate compounds are effective, including monoazo metal complexes, acetylyacetone metal complexes, and metal complexes of an aromatic hydroxycarboxylic acid type and an aromatic dicarboxylic acid type, also including aromatic hydroxycarboxylic acids, aromatic mono- or polycarboxylic acids, and metal salts, anhydrides or esters thereof, as well as phenol derivatives such as bisphenol and urea-type compounds.

As an agent for controlling the toner to be positively chargeable, it may include Nigrosine and products modified with a fatty acid metal salt; quaternary ammonium salts such as tributylbenzylammonium 1-hydroxy-4-naphthoslulfonate and tetrabutylammonium teterafluoroborate, and analogues of these, including onium salts such as phosphonium salts and lake pigments of these; triphenyl methane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides). Metal salts of higher fatty acids may also be used, specifically including diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in a combination of two or more kinds. Of these, charge control agents such as Nigrosine types and quaternary ammonium salts may particularly preferably be used.

Fine silica powder may preferably be added to the toner of the present invention in order to improve charge stability, developability, fluidity and running performance. As the fine silica powder used in the present invention, those having a specific surface area, as measured by the BET method using nitrogen absorption, of not less than 30 $m^2/g$, and preferably in the range of from 50 to 400 $m^2/g$, can give good results. The fine silica powder may preferably be used in an amount of from 0.01 to 8 parts by weight, and more preferably from 0.1 to 5 parts by weight, based on 100 parts by weight of the toner.

The fine silica powder used in the present invention may preferably be optionally treated, for the purpose of making it hydrophobic or controlling its chargeability, with a treating agent such as silicone varnish, each sort of modified silicone varnish, silicone oil, each sort of modified silicone oil, a silane coupling agent, a silane coupling agent having a functional group, or other organic silicon compound, which may be used alone or in a combination of some kinds.

As other additives, they can be exemplified by lubricant powder such as Teflon powder, zinc stearate powder and polyvinylidene fluoride powder (in particular, polyvinylidene fluoride powder, is preferred); abrasives such as cerium oxide powder, silicon carbide powder and strontium titanate powder (in particular, strontium titanate powder is preferred); fluidity-providing agents as exemplified by titanium oxide powder and aluminum oxide powder (in particular, hydrophobic one is preferred); anti-caking agents; conductivity-providing agents such as carbon black powder, zinc oxide powder, antimony oxide powder and tin oxide powder; and developability improver of white fine particles and black fine particles which are opposite in polarity; which may be used in small amounts.

The toner of the present invention, when used as a two-component developer, is used as a mixture with a carrier powder. In this case, the toner and the carrier powder may preferably be mixed in such a proportion that the toner is in concentration of 0.1 to 50% by weight, more preferably from 0.5 to 10% by weight, and still more preferably from 3 to 10% by weight.

As the carrier usable in the present invention, known carriers can be used, including, for example, magnetic powders such as iron powder, ferrite powder and nickel powder, glass beads, and these powders or glass beads whose surfaces have been treated with a fluorine resin, a vinyl resin or a silicone resin.

The toner of the present invention may also be further incorporated with a magnetic material so that it can be used as a magnetic toner. In this case, the magnetic material may also serve as a colorant. In the present invention, the magnetic material contained in the magnetic toner may include iron oxides such as magnetite, hematite and ferrite; magnetic metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These ferromagnetic materials may be those having an average particle diameter of 2 $\mu$m or less, and preferably from 0.1 to 0.5 $\mu$m, in approximation. Any of these materials may be contained in the toner preferably in an amount of from about 20 to about 200 parts by weight, and particularly preferably from 40 to 150 parts by weight, based on 100 parts by weight of the resin component.

The magnetic material may also preferably be those having a coercive force (Hc) of from 20 to 300 oersted, a saturation magnetization ($\sigma s$) of from 50 to 200 emu/g and a residual magnetization ($\sigma r$) of from 2 to 20 emu/g, as magnetic characteristics under application of 10 K oersted.

The colorant usable in the present invention may include any suitable pigments or dyes. The colorant for the toner can be exemplified by pigments including carbon black, aniline black, acetylene black, Naphthol Yellow, Hanza Yellow, Rhodamin Lake, Alizanine Lake, red iron oxide, Phthalocyanine Blue and Indanthrene Blue. Any of these may be used in an amount necessary and enough to maintain the optical density of fixed images, preferably from 0.1 to 20 parts by weight, and more preferably from 0.2 to 10 parts by weight, based on 100 parts by weight of the resin. For the same purpose, a dye may also be used. For example, it may include azo dyes, anthraquinone dyes, xanthene dyes and methine dyes, and may preferably be added in an amount of from 0.1 to 20 parts by weight, and more preferably from 0.3 to 10 parts by weight, based on 100 parts by weight of the resin.

The toner for developing electrostatic images according to the present invention can be produced in the following way: The binder resin and the wax, as well as the metal salt or metal complex, the pigment or dye as the colorant, the magnetic material, and optionally the charge control agent and other additives are thoroughly mixed using a mixing machine such as a Henschel mixer or a ball mill, and then the mixture is melt-kneaded using a heat kneading machine such as a heating roll, a kneader or an extruder to make the resin and so on melt one another, in which a metal compound, a pigment, a dye and a magnetic material are then dispersed or dissolved, followed by cooling for solidification and thereafter pulverization and classification. Thus the toner for developing electrostatic images according to the present invention can be obtained.

If necessary, any desired additives may be further thoroughly mixed using a mixing machine such as a Henschel mixer. Thus, the toner for developing electrostatic images according to the present invention can also be obtained.

The heat fixing method of the present invention will be described with reference to FIGS. 5 and 6.

The toner of the present invention is imagewise heat-fixed on a recording medium (transfer medium) such as plain paper or a transparent sheet for overhead projector (OHP) by a contact heat fixing means.

The contact heat fixing means may include fixing means used in a heating pressure roll fixing assembly, or heating means carried out using a heater element stationarily supported and a pressure member that stands opposite to the heat element in pressure contact and brings the transfer medium into close contact with the heater element through a film interposed between them. An example of such a heating means is shown in FIG. 5.

Figure 5:
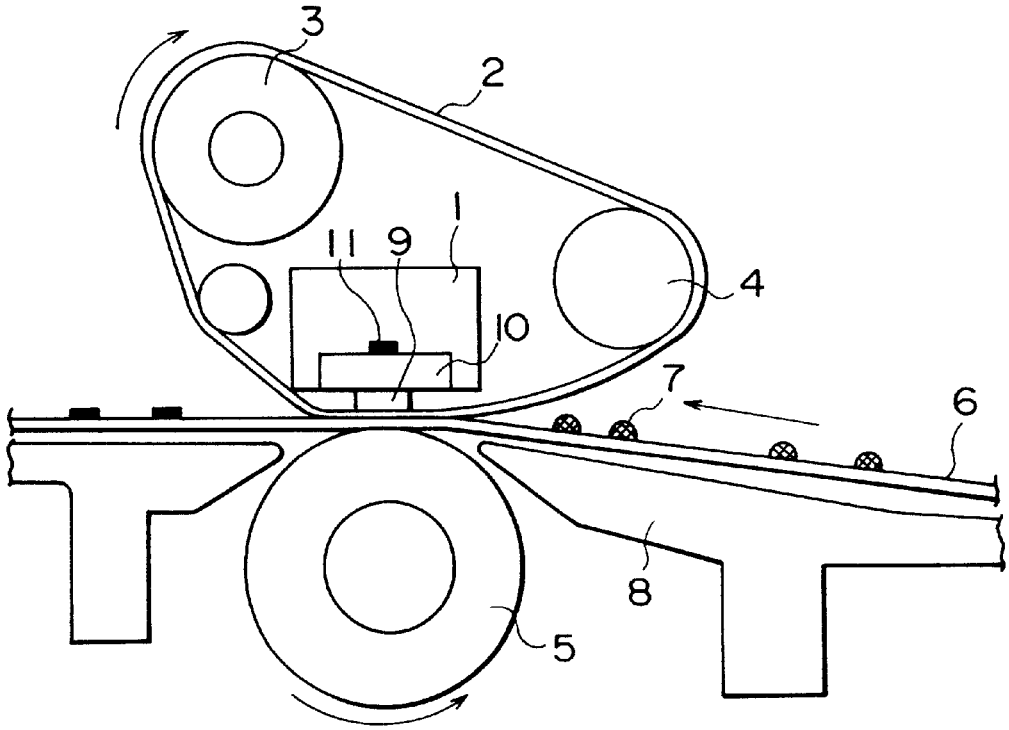
FIG. 5 schematically illustrates an example of a fixing assembly for carrying out the heat fixing method of the present invention.

In the fixing assembly shown in FIG. 5, a heater element has a smaller heat capacity than conventional heat rolls, and has a linear heating part. The heating part may preferably be made to have a maximum temperature of from 100° C. to 300° C.

The film interposed between the heater element and a pressure member may preferably be a heat-resistant sheet of from 1 to 100 μm thick. Heat-resistant sheets that can be used therefor may include sheets of polymers having high heat-resistance, such as polyester, PET (polyethylene terephthalate), PFA (a tetrafluoroethylene-perfluoroalkyl vinyl ether copolymer), PTFE (polytetrafluoroethylene), polyimide and polyamide, sheets of metals such as aluminum, and laminate sheets comprised of a metal sheet and a polymer sheet.

In a preferred constitution of the film, these heat-resistant sheets have a release layer and/or a low-resistance layer.

An embodiment of the fixing assembly will be described with reference to FIG. 5.

In FIG. 5, reference numeral 1 denotes a low heat capacity linear heater element stationarily supported in the fixing assembly. An example thereof is comprised of an alumina substrate 10 of 1.0 mm in thickness, 10 mm in width and 240 mm in longitudinal length and a resistance material 9 coated thereon in a width of 1.0 mm, which is electrified from the both ends in the longitudinal direction. The electricity is applied under variations of pulse widths of the pulses corresponding to the desired temperatures and energy emission quantities which are controlled by a temperature sensor 11, in the pulsewise waveform with a period of 20 msec of DC 100 V. The pulse widths range approximately from 0.5 msec to 5 msec. In contact with the heater element 1 the energy and temperature of which have been controlled in this way, a fixing film 2 moves in the direction of an arrow shown in the drawing.

An example of this fixing film can be an endless film comprised of a heat-resistant sheet of 20 μm thick (for example, polyimide, polyetherimide, PES, or PFA) and a release layer formed of a fluorine resin such as PTFE or PFA to which a conductive material is added, which is coated in a thickness of 10 μm at least on the side coming into contact with images. In general, the total thickness of the film may preferably be less than 100 μm, and more preferably less than 40 μm. The film is moved in the direction of the arrow in a wrinkle-free state by the drive and tension due to a drive roller 3 and a follower roller 4.

In the drawing, reference numeral 5 denotes a pressure roller having on its surface an elastic layer of rubber with good release properties as exemplified by silicone rubber. This pressure roller is pressed against the heater element at a total pressure of 4 to 20 kg through the film interposed between them and is rotated in pressure contact with the film. Unfixed toner 7 on a transfer medium 6 is led to the fixing zone by means of an inlet guide 8. A fixed image is thus obtained by the heating described above.

The above has been described with reference to an embodiment in which the fixing film is an endless belt. A sheet-feeding shaft and a wind-up shaft may also be used, and the fixing film may not be endless.

Figure 6:
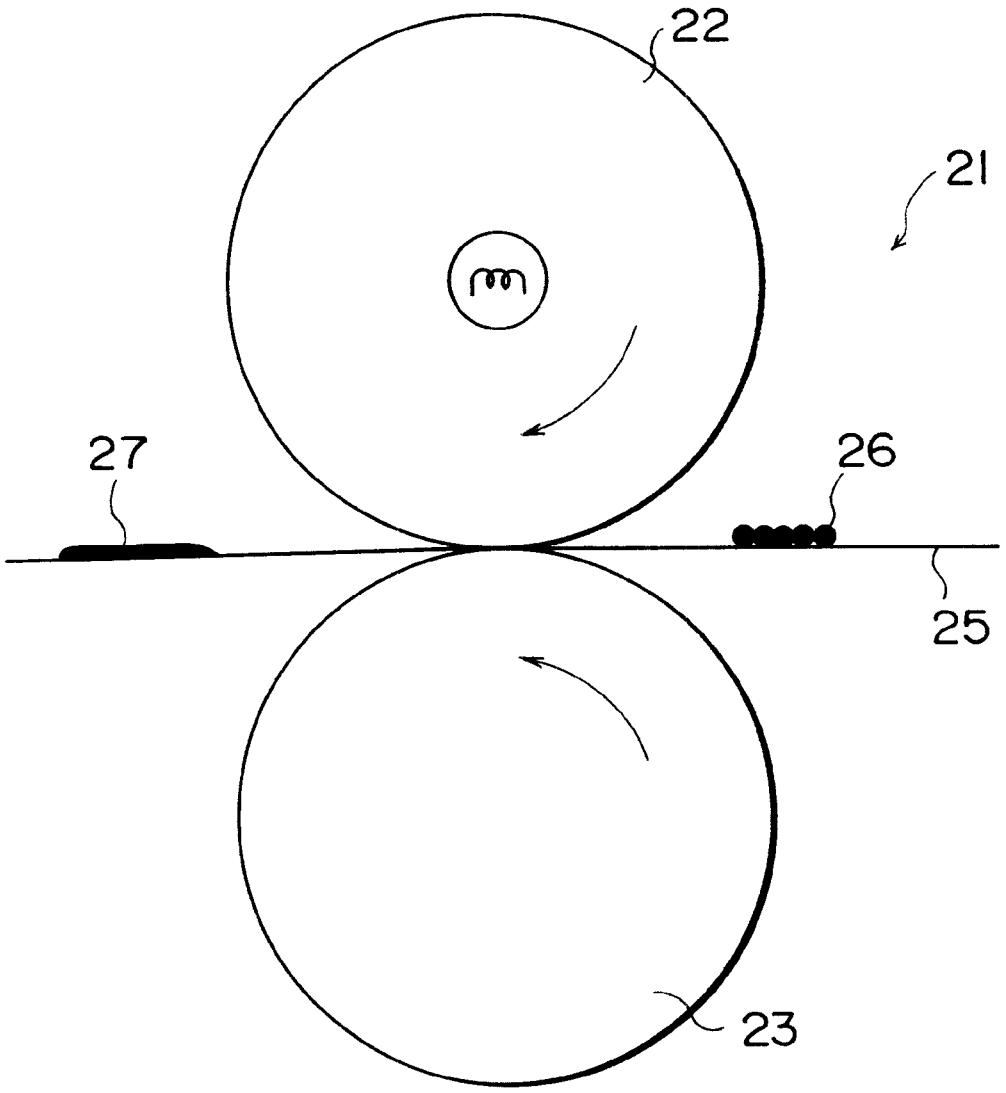
FIG. 6 schematically illustrates another example of a fixing assembly for carrying out the heat fixing method of the present invention.

FIG. 6 illustrates another fixing assembly that can be used in the heat fixing method of the present invention.

In FIG. 6, reference numeral 21 denotes a fixing means having a fixing roll 22 and a pressure roll 23. The fixing roll 22 and the pressure roll 23 are brought into pressure contact under a given pressure. A recording medium 25 having an unfixed toner image 26 passes between the fixing roll 22 and the pressure roll 23, so that heat and pressure are applied to the recording medium and the unfixed toner image is fixed on the recording medium 25 to form a fixed toner image. The heating roll 22 is provided in its inside with a heating means 24 such as a halogen lamp heater.

The heat fixing method of the present invention can be applied to fixing assemblies of image forming apparatus for forming images by the use of toners, such as copying machines, printers and facsimile machines.

The toner for developing electrostatic images according to the present invention has at least a binder resin and a wax, where the binder resin contains as a primary component the polyester resin having the soft segment and the wax has the specific thermal properties. Hence, the wax having the specific thermal properties is well dispersed in the binder resin, and hence the wax having the specific thermal properties, having superior sharp-melt properties can be made well effective, so that the toner can have good low-temperature fixing performance and also superior developing performance while maintaining low-temperature to high-temperature anti-offset properties and blocking resistance.

EXAMPLES

The present invention will be described below in greater detail by giving Examples.

Preparation Example 1

Preparation of Non-linear Polyester Resin A

| | |
|---|---|
| Polyoxyethylene (3)-2,2-bis(4-hydroxyphenyl)propane | 48 mol % |
| Terephthalic acid | 18 mol % |
| Trimellitic anhydride | 18 mol % |
| n-Dodecenylsuccinic acid | 16 mol % |

The above materials in a total amount of 1,500 g were put into a four-necked flask equipped with a thermometer, a stirrer, a nitrogen-feeding tube and a condenser. Subsequently, the flask was placed in a mantle heater, nitrogen gas was fed so that the inside of the reaction vessel was made to keep an inert atmosphere, and then temperature was raised. Thereafter, 0.05 g of dibutyltin oxide was added, the temperature was maintained at 210° C., and polycondensation reaction was carried out for 12 hours to obtain a non-linear polyester resin A. This non-linear polyester resin had an acid value of 15 mg•/g. The acid value was measured according to JIS K 5902.

Preparation Example 2

Preparation of Linear Polyester Resin B

| | |
|---|---|
| Polyoxypropylene (2,5)-2,2-bis(4-hydroxyphenyl)propane | 50 mol % |
| Triethylene glycol | 12 mol % |
| Fumaric acid | 17 mol % |
| n-Dodecenylsuccinic acid | 21 mol % |

The above materials were subjected to polycondensation in the same manner as in Preparation Example 1 to obtain a linear polyester resin B. This linear polyester resin had an acid value of 12 mg•/g.

Preparation Example 3

Preparation of Non-linear Polyester Resin C

| | |
|---|---|
| Polyoxyethylene (3)-2,2-bis(4-hydroxyphenyl)propane | 52 mol % |
| Terephthalic acid | 30 mol % |
| Trimellitic anhydride | 18 mol % |

The above materials were subjected to polycondensation in the same manner as in Preparation Example 1 to obtain a non-linear polyester resin C. This non-linear polyester resin had an acid value of 13 mg•/g.

Preparation Example 4

Preparation of Non-linear Polyester Resin D

| | |
|---|---|
| Polyoxyethylene (3)-2,2-bis(4-hydroxyphenyl)propane | 45 mol % |
| Terephthalic acid | 5 mol % |
| Trimellitic anhydride | 18 mol % |
| n-Dodecenylsuccinic acid | 32 mol % |

The above materials were subjected to polycondensation in the same manner as in Preparation Example 1 to obtain a non-linear polyester resin D. This non-linear polyester resin had an acid value of 15 mg•/g.

Preparation Example 5

Preparation of Linear Polyester Resin E

| | |
|---|---|
| Polyoxypropylene (2,5)-2,2-bis(4-hydroxyphenyl)propane | 50 mol % |
| Triethylene glycol | 12 mol % |
| Fumaric acid | 38 mol % |

The above materials were subjected to polycondensation in the same manner as in Preparation Example 1 to obtain a linear polyester resin E. This linear polyester resin had an acid value of 12 mg•/g.

Preparation Example 6

Preparation of Non-linear Polyester Resin A-1

The same materials as used in Preparation Example 1 were charged into a reaction vessel made of stainless steel, having a distillation column, a pressure reducing device and a stirring blade. While maintaining the inside at 210° C. and rotating the stirring blade, the reaction was carried out. The vessel was evacuated to a pressure of 5 mmHg when the water evaporation stopped after 4 hours. As diol components were distilled, the rotational load on the stirring blade gradually increased and the load abruptly began to increase after 1.5 hours. At this stage, the inside pressure was changed to 50 mmHg, so that the increase in the stirring load was slackened. This operation was repeated several times until the inside pressure came to be 150 mmHg, so that distillate components became little produced and also the stirring load was within 3 times that at the start. At this stage, the inside pressure was returned to normal pressure and then the stirring was continued. After returned to normal pressure, the stirring load was little seen to increase, and after 1 hour a polymerization product was taken out to obtain a non-linear polyester resin A-1. This non-linear polyester resin A-1 had an acid value of 8 mg•/g.

Preparation Example 7

Preparation of Non-linear Polyester Resin A-2

The same materials as used in Preparation Example 1 were charged into a reaction vessel made of stainless steel, having a distillation column, a pressure reducing device and a stirring blade. While maintaining the inside at 210° C. and rotating the stirring blade, the reaction was carried out. The vessel was evacuated to a pressure of 5 mmHg when water evaporation stopped after 4 hours. As diol components were distilled, the rotational load on the stirring blade gradually increased and the load abruptly began to increase after 1.5 hours. At this stage, the inside pressure was changed to 50 mmHg, so that the increase in the stirring load was slackened. This operation was repeated several times until the inside pressure came to be 300 mmHg, so that distillate components became little produced and also the stirring load was within 3 times that at the start. At this stage, the inside pressure was returned to normal pressure and then the stirring was continued. After returned to normal pressure, the stirring load was little seen to increase, and after 1 hour a polymerization product was taken out to obtain a non-linear polyester resin A-2. This non-linear polyester resin A-2 had an acid value of 1.0 mg•/g.

Preparation Example 8

Preparation of Linear Polyester Resin B-1

Polymerization was carried out in the same manner as in Preparation Example 6 to obtain a linear polyester resin B-1, except that the materials used in Preparation Example 6 were replaced with the same materials as used in Preparation Example 2. This linear polyester resin B-1 had an acid value of 7 mg•/g.

Preparation Example 9

Preparation of Linear Polyester Resin B-2

Polymerization was carried out in the same manner as in Preparation Example 7 to obtain a linear polyester resin B-2, except that the materials used in Preparation Example 7 were replaced with the same materials as used in Preparation Example 2. This linear polyester resin B-2 had an acid value of 2.0 mg•/g.

Preparation Example 10

Preparation of Non-linear Polyester Resin C-1

Polymerization was carried out in the same manner as in Preparation Example 7 to obtain a non-linear polyester resin C-1, except that the materials used in Preparation Example 7 were replaced with the same materials as used in Preparation Example 3. This linear polyester resin C-1 had an acid value of 1.5 mg•/g.

Preparation Example 11

Preparation of Linear Polyester Resin E-1

Polymerization was carried out in the same manner as in Preparation Example 7 to obtain a linear polyester resin E-1, except that the materials used in Preparation Example 7 were replaced with the same materials as used in Preparation Example 5. This linear polyester resin E-1 had an acid value of 3.0 mg•/g.

Waxes A to G

A hydrocarbon wax F synthesized by the Arge process from a synthesized gas comprised of carbon monoxide and hydrogen was subjected to fractionation crystallization to obtain wax A, wax B and wax C.

Ethylene was subjected to low-pressure polymerization in the presence of a Ziegler catalyst to obtain a relatively low-molecular weight wax E.

A thermally decomposed wax, low-molecular weight polypropylene BISKOL 550P (wax G) was commercially obtained.

Figure 2:
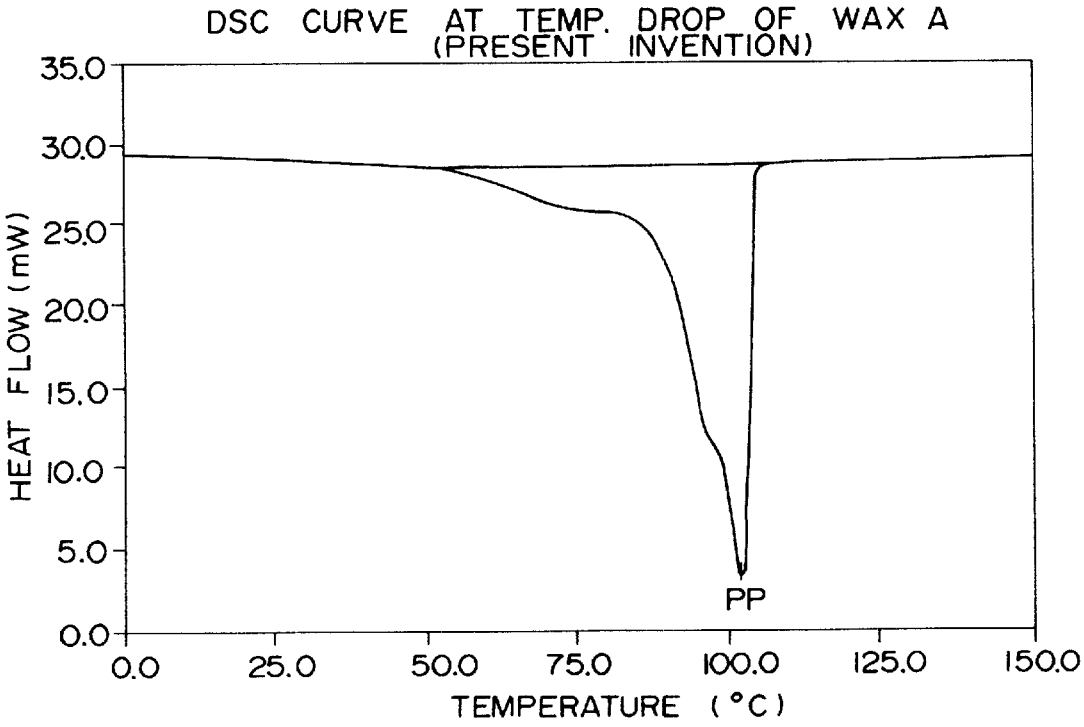
FIG. 2 illustrates the DSC curve at the time of temperature drop, of wax A used in Examples.
Figure 3:
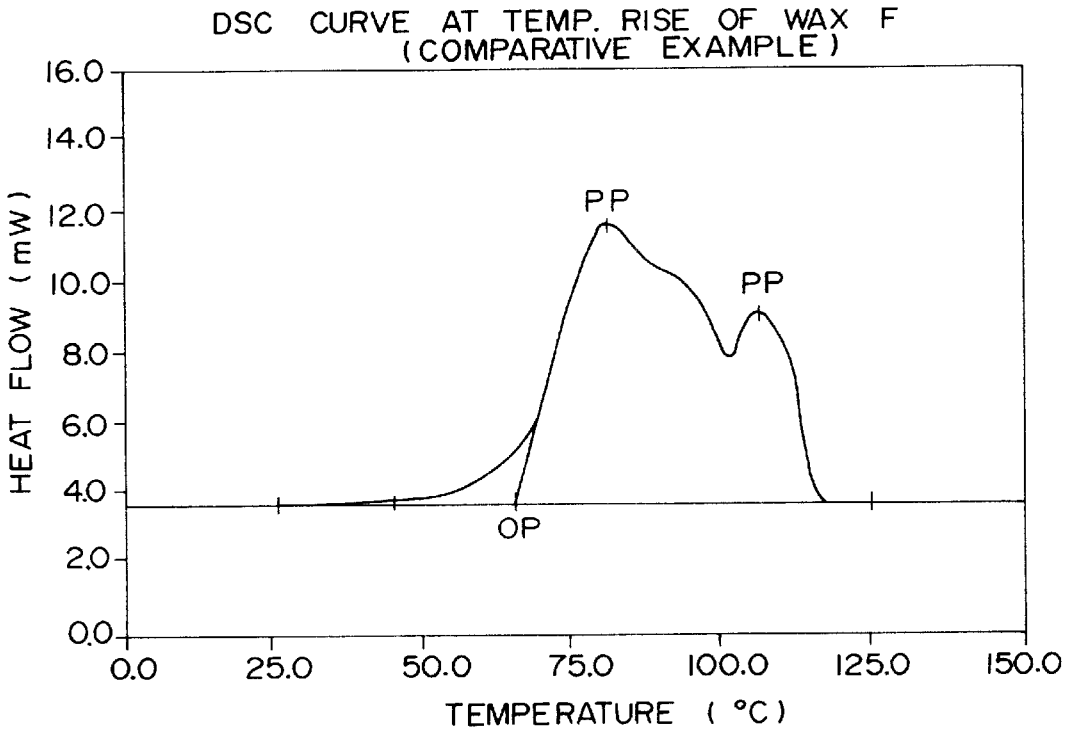
FIG. 3 illustrates the DSC curve at the time of temperature rise, of wax F used in Comparative Examples.
Figure 4:
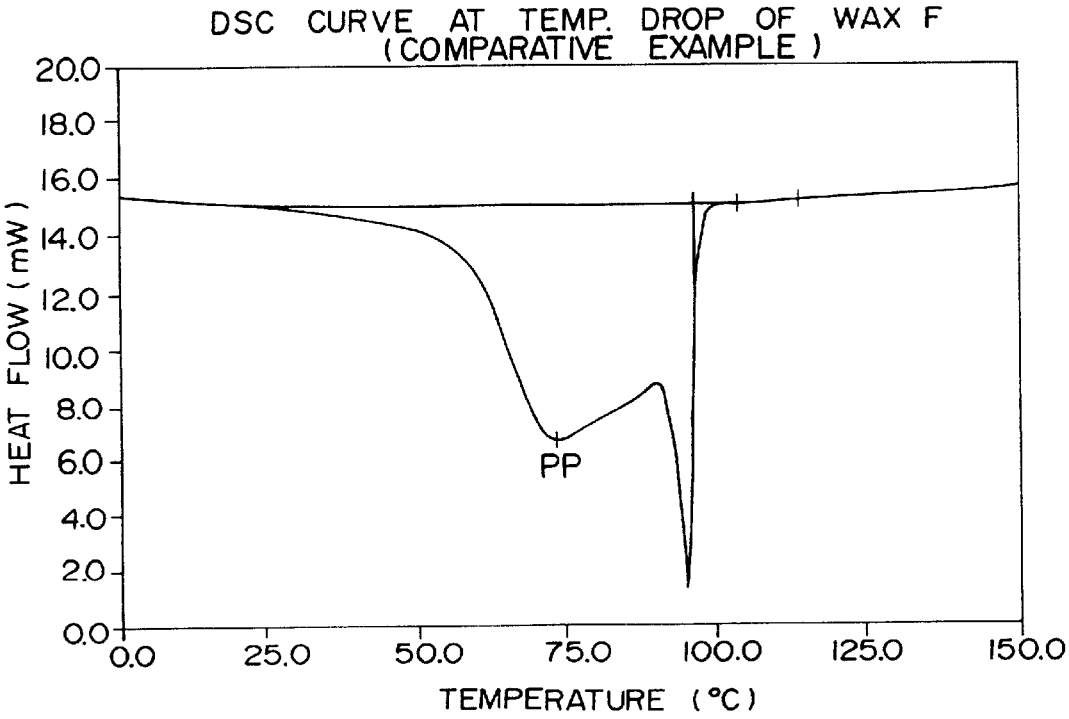
FIG. 4 illustrates the DSC curve at the time of temperature drop, of wax F used in Comparative Examples.

Physical properties of these waxes A to G are shown in Tables 1 to 3. DSC curves of the wax A are also shown in FIGS. 1 and 2, and DSC curves of the wax F are shown in FIGS. 3 and 4.

TABLE 1

DSC Characteristics of Wax

| Wax | At temperature rise: Onset temp. (° C.) | At temperature rise: Endothermic peak temp. (° C.)*2 | At temperature drop: Maximum exothermic peak temp. (° C.) | At temperature drop: Temperature difference (° C.) |
|---|---|---|---|---|
| A | 65 | 104 113 | 105 | 1 (105–104) |
| B | 61 | 102 110 | 103 | 1 (103–102) |
| C | 58 | 99 113 | 100 | 1 (100–99) |
| D | 55 | 106 125 | 101 | 5 (106–101) |
| E*1 | 45 | 103 118 | 106 | 3 (106–103) |
| F*1 | 63 | 83 108 | 96 | 12 (108–96) |
| G*1 | 127 | 137 145 | 101 | 36 (137–101) |

*1 For comparison
G: VISCOL 550p
*2 The underlined endothermic peak temperature indicates a maximum peak.

TABLE 2

| Wax | Molecular Weight Distribution of Wax (measured by GPC): Mn | Mw | Mw/Mn |
|---|---|---|---|
| A | 840 | 1,350 | 1.61 |
| B | 650 | 1,080 | 1.66 |
| C | 620 | 1,150 | 1.85 |
| D | 750 | 1,720 | 2.29 |
| E*1 | 580 | 1,650 | 2.84 |
| F*1 | 550 | 940 | 1.71 |
| G*1 | 2,200 | 12,500 | 5.68 |

Remarks: In respect of wax G (BISKOL 550p), values calculated as polypropyrene.
*1 For comparison
G: VISCOL 550p

TABLE 3

Physical Properties of Wax

| Wax | Penetration ($10^{-1}$mm) | Density (g/cm$^3$) | Melt viscosity (cp) | Softening point (° C.) |
|---|---|---|---|---|
| A | 0.5 | 0.96 | 16 | 118 |
| B | 0.5 | 0.96 | 11 | 106 |
| C | 1.0 | 0.96 | 8 | 102 |
| D | 1.0 | 0.97 | 18 | 115 |
| E*1 | 2.0 | 0.94 | 12 | 120 |
| F*1 | 1.5 | 0.96 | 15 | 109 |
| G*1 | 0.5 | 0.89 | 250 | 150 |

Remarks: Melt viscosity was measured at temperature 150° C. for wax G (VISCOL 550p), and at 140° C. for other waxes.
*1 For comparison
G: VISCOL 550p Preparation of Toner 1

| | (by weight) |
|---|---|
| Non-linear polyester resin A | 100 parts |
| Magnetite | 70 parts |
| Urea type negative charge control agent | 2 parts |
| Wax A | 4 parts |

The above materials were premixed, and then melt-kneaded using a twin-screw kneading extruder set to 130° C. The kneaded product was cooled, and then crushed. Thereafter the crushed product was finely pulverized by means of a grinding mill making use of a jet stream, followed by classification using an air classifier to obtain toner particles (a toner) with a weight average particle diameter of 11.5 $\mu$m. Based on 100 parts by weight of the toner particles obtained, 0.4 part by weight of hydrophobic fine colloidal silica powder was externally added to obtain toner 1, which was prepared as a one-component type developer.

Preparation of Toner 2

Toner 2 was prepared as a one-component type developer in the same manner as in Preparation of Toner 1 except that the wax A was replaced with wax B.

Preparation of Toner 3

Toner 3 was prepared as a one-component type developer in the same manner as in Preparation of Toner 1 except that the wax A was replaced with wax C.

Preparation of Toner 4

Toner 4 was prepared as a one-component type developer in the same manner as in Preparation of Toner 1 except that the wax A was replaced with wax D.

Preparation of Toner 5

Toner 5 was prepared as a one-component type developer in the same manner as in Preparation of Toner 1 except that 100 parts by weight of the non-linear polyester resin A was replaced with 75 parts by weight of linear polyester resin B and 25 parts by weight of non-linear polyester resin C and the urea type negative charge control agent was replaced with a monoazo chromium complex type negative charge control agent.

Preparation of Toner 6

Toner 6 was prepared as a one-component type developer in the same manner as in Preparation of Toner 1 except that 100 parts by weight of the non-linear polyester resin A was replaced with 50 parts by weight of linear polyester resin E and 50 parts by weight of non-linear polyester resin A and the urea type negative charge control agent was replaced with a monoazo chromium complex type negative charge control agent.

Preparation of Toner 7

Toner 7 was prepared as a one-component type developer in the same manner as in Preparation of Toner 1 except that 100 parts by weight of the non-linear polyester resin A was replaced with 75 parts by weight of linear polyester resin B, 15 parts by weight of non-linear polyester resin A and 10 parts by weight of non-linear polyester resin C and the urea type negative charge control agent was replaced with a monoazo chromium complex type negative charge control agent.

Preparation of Toner 8

Toner 8 was prepared as a one-component type developer in the same manner as in Preparation of Toner 1 except that 100 parts by weight of the non-linear polyester resin A was replaced with 75 parts by weight of linear polyester resin B and 25 parts by weight of non-linear polyester resin A and the urea type negative charge control agent was replaced with a monoazo chromium complex type negative charge control agent.

Preparation of Toner 9

Toner 9 was prepared as a one-component type developer in the same manner as in Preparation of Toner 1 except that the wax A was replaced with wax E.

Preparation of Toner 10

Toner 10 was prepared as a one-component type developer in the same manner as in Preparation of Toner 1 except that the wax A was replaced with wax F.

Preparation of Toner 11

Toner 11 was prepared as a one-component type developer in the same manner as in Preparation of Toner 1 except that the wax A was replaced with wax G.

Preparation of Toner 12

Toner 12 was prepared as a one-component type developer in the same manner as in Preparation of Toner 1 except that the non-linear polyester resin A was replaced with non-linear polyester resin D and the wax A was replaced with wax E.

Preparation of Toner 13

Toner 13 was prepared as a one-component type developer in the same manner as in Preparation of Toner 1 except that the non-linear polyester resin A was replaced with non-linear polyester resin C.

Preparation of Toner 14

Toner 14 was prepared as a one-component type developer in the same manner as in Preparation of Toner 1 except that 100 parts by weight of the non-linear polyester resin A was replaced with 30 parts by weight of non-linear polyester resin A and 70 parts by weight of non-linear polyester resin C.

Preparation of Toner 15

Toner 15 was prepared as a one-component type developer in the same manner as in Preparation of Toner 1 except that 100 parts by weight of the non-linear polyester resin A was replaced with 75 parts by weight of linear polyester resin E and 25 parts by weight of non-linear polyester resin C.

Make-up of each toner is shown in Table 4.

TABLE 4

Make-up of Toner

| Toner | Binder resin (pvw) | Wax |
|---|---|---|
| 1 | Non-linear polyester resin A (100) | A |
| 2 | Non-linear polyester resin A (100) | B |
| 3 | Non-linear polyester resin A (100) | C |
| 4 | Non-linear polyester resin A (100) | D |
| 5 | Linear polyester resin B (75)/non-linear polyester resin C (25) | A |
| 6 | Linear polyester resin E (50)/non-linear polyester resin A (50) | A |
| 7 | Linear polyester B (75)/non-linear polyester A (15)/non-linear polyester C (10) | A |
| 8 | Linear polyester resin B (75)/non-linear polyester resin A (25) | A |
| 9 | Non-linear polyester resin A (100) | E |
| 10 | Non-linear polyester resin A (100 | F |
| 11 | Non-linear polyester resin A (100) | G*1 |
| 12 | Non-linear polyester resin D (100) | E |
| 13 | Non-linear polyester resin C (100) | A |
| 14 | Non-linear polyester resin A (30)/non-linear polyester resin C (70) | A |
| 15 | Linear polyester resin E (75)/non-linear polyester resin C (25) | A |

*1 VISCOL 550p

Examples 1–8

Using toners 1 to 15, the following fixing and offset test 1, fixing and offset test 2, blocking test and developing test were made.

Fixing and Offset Test 1

Unfixed images were obtained using a commercially available electrophotographic copying machine NP-6650 (manufactured by Canon Inc.) from which its fixing assembly was detached. Fixing and offset tests were made by fixing the unfixed toner images, using a heat roller fixing assembly of NP-6650 modified into a temperature-variable heat roller fixing assembly (fixing means as shown in FIG. 6). The test was carried out at a process speed of 100 mm/sec within the temperature range of from 100 to 230° C. controlled at intervals of 5° C.

In the test for low-temperature offset and fixing, paper of 80 g/m$^2$ was used. In the test for high-temperature offset, paper of 52 g/m$^2$ was used. To test the fixing performance, the fixed images were rubbed with Silbon paper, lens cleaning paper "DASPER" (trademark; Ozu Paper Co., Ltd.) under application of a load of 50 g/cm$^2$, and the temperature at which the rate of decrease in image density before and after the rubbing was less than 10% was regarded as the fixing starting temperature. With regard to the offset test, the temperature at which offset became no longer seen in visual observation was regarded as the low-temperature offset-free starting point, and, after the temperature was raised, the maximum temperature at which the offset no longer appeared was regarded as offset-free end point. The test results are summarized in Table 5. In Table 5, fixing starting temperature, rate of decrease in image density at 150° C., low-temperature offset-free point, high-temperature offset-free point, and non-offset temperature region are shown.

Fixing and Offset Test 2

Unfixed images were formed on recording mediums using a commercially available electrophotographic copying machine NP-6650 (manufactured by Canon Inc.). Fixing and offset tests were made by fixing the unfixed toner images, using the external fixing device as shown in FIG. 5, comprising the pressure member 5 that stands opposite to the heater element 1 in pressure contact and brings the recording medium 6 into close contact with the heater element interposing the film 2 between them. Used as a material of the fixing film 2 was an endless film comprising a polyimide film coated, in a thickness of 10 $\mu$m, with a release layer of a fluorine resin to which a conductive material was added. A silicone rubber was used for the pressure roller 5, and the fixing test was carried out with a nip of 3.5 mm, under a total pressure of 8 kg between the heater element 1 and the pressure roller 5, at a process speed of 50 mm/sec and under variable temperature control. The film was moved by the drive and tension between the drive roller 3 and the follower roller 4. Energy was pulsewise applied to the low heat capacity linear heater element 1 to control temperature.

In the test for low-temperature offset and fixing, paper of 80 g/m$^2$ was used. In the test for high-temperature offset, paper of 52 g/m$^2$ was used. To test the fixing performance, the fixed images were rubbed with Silbon paper, lens cleaning paper "DASPER" (trademark; Ozu Paper Co., Ltd.) under application of a load of 50 g/cm$^2$, and the temperature at which the rate of decrease in image density before and after the rubbing was less than 10% was regarded as the fixing starting temperature. With regard to the offset test, the temperature at which offset became no longer seen in visual observation was regarded as low-temperature offset-free starting point, and, after the temperature was raised, the maximum temperature at which the offset no longer appeared was regarded as offset-free end point. The test results are summarized in Table 6. In Table 6, fixing starting temperature, rate of decrease in image density at 150° C., low-temperature offset-free point, high-temperature offset-free point, and non-offset temperature region are shown.

Blocking Test

About 20 g of developer was put in a 100 cc polyethylene cup and left to stand at 50° C. for three days. Thereafter, blocking was visually evaluated. Results obtained are shown in Table 7.

Developing Test

About 100 g of developer was put in a 500 cc polyethylene cup and left standing at 45° C. for three days. Thereafter, developing performance was evaluated on images formed after copying 20 sheets using a commercially available electrophotographic copying machine NP-270Z (manufactured by Canon Inc.). The test results (image density and fog) are shown in Table 7. This test can be used for simulation to examine durability to in-machine temperature rise and storage stability in long-term leaving.

TABLE 5

Fixing and Offset Test 1

| | | Fixing | | Non-offset temp. region | | |
|---|---|---|---|---|---|---|
| | Toner No. | Fixing start. temp. (° C.) | Rate of density decrease (%) | Low-temp. starting point/A (° C.) | High-temp. starting point/B (° C.) | B - A (° C.) |
| Example: | | | | | | |
| 1 | 1 | 120 | 2 | 115 | 205 | 90 |
| 2 | 2 | 115 | 1 | 110 | 200 | 90 |
| 3 | 3 | 110 | 1 | 105 | 190 | 85 |
| 4 | 4 | 120 | 2 | 115 | 200 | 85 |
| 5 | 5 | 110 | 1 | 110 | 190 | 80 |
| 6 | 6 | 115 | 2 | 115 | 200 | 85 |
| 7 | 7 | 105 | 1 | 105 | 185 | 80 |
| 8 | 8 | 95 | 1 | 95 | 175 | 80 |
| Comparative Example: | | | | | | |
| 1 | 9 | 120 | 2 | 120 | 190 | 70 |
| 2 | 10 | 120 | 2 | 120 | 180 | 60 |
| 3 | 11 | 150 | 10 | 145 | 200 | 55 |
| 4 | 12 | 110 | 1 | 110 | 180 | 70 |
| 5 | 13 | 140 | 8 | 130 | 200 | 70 |
| 6 | 14 | 135 | 5 | 130 | 220 | 90 |
| 7 | 15 | 125 | 4 | 125 | 185 | 60 |

TABLE 6

Fixing and Offset Test 2

| | | Fixing | | Non-offset temp. region | | |
|---|---|---|---|---|---|---|
| | Toner No. | Fixing start. temp. (° C.) | Rate of density decrease (%) | Low-temp. starting point/A (° C.) | High-temp. starting point/B (° C.) | B - A (° C.) |
| Example: | | | | | | |
| 1 | 1 | 135 | 4 | 130 | 225 | 95 |
| 2 | 2 | 130 | 4 | 125 | 220 | 95 |
| 3 | 3 | 125 | 3 | 120 | 210 | 90 |
| 4 | 4 | 130 | 3 | 125 | 210 | 85 |
| 5 | 5 | 120 | 1 | 120 | 200 | 80 |
| 6 | 6 | 125 | 2 | 125 | 215 | 90 |
| 7 | 7 | 110 | 2 | 110 | 195 | 85 |
| 8 | 8 | 100 | 1 | 100 | 185 | 90 |
| Comparative Example: | | | | | | |
| 1 | 9 | 140 | 6 | 140 | 210 | 70 |
| 2 | 10 | 140 | 6 | 135 | 200 | 65 |
| 3 | 11 | 160 | 17 | 155 | 230 | 75 |
| 4 | 12 | 135 | 3 | 135 | 210 | 75 |
| 5 | 13 | 155 | 12 | 145 | 230 | 85 |
| 6 | 14 | 145 | 10 | 140 | 235 | 95 |
| 7 | 15 | 135 | 7 | 137 | 200 | 65 |

TABLE 7

Blocking Resistance and Developing Test

| | Toner | *1 Blocking resistance (storage stability) | *2 Developing Performance Image density | Fog |
|---|---|---|---|---|
| Example: | | | | |
| 1 | Toner 1 | AA | 1.40 | AA |
| 2 | Toner 2 | AA | 1.38 | AA |
| 3 | Toner 3 | A | 1.35 | AA |
| 4 | Toner 4 | B | 1.30 | A |
| 5 | Toner 5 | A | 1.33 | A |
| 6 | Toner 6 | A | 1.35 | AA |
| 7 | Toner 7 | A | 1.38 | A |
| 8 | Toner 8 | A | 1.40 | A |
| Comparative Example: | | | | |
| 1 | Toner 9 | C | 1.15 | B |
| 2 | Toner 10 | B | 1.25 | A |
| 3 | Toner 11 | AA | 1.44 | A |
| 4 | Toner 12 | CC | 1.03 | B |
| 5 | Toner 13 | AA | 1.37 | A |
| 6 | Toner 14 | AA | 1.40 | A |
| 7 | Toner 15 | A | 1.33 | A |

*1 Evaluation criteria of blocking resistance (storage stability):
AA: Excellent; no agglomerates are seen.
A: Good; agglomerates are seen but can be broken up with ease.
B: Passable; agglomerates are seen, but can be broken up when shaked.
C: Failure; agglomerates can be held with fingers and can not be broken up with ease.
CC: Very poor; agglomerates can not be broken up.
*2 Evaluation criteria of fog for developing performance:
AA: Excellent; A: Good; B: Passable; C: Failure;
CC: Very poor.

Preparation of Toner 16

| | (by weight) |
|---|---|
| Non-linear polyester resin A | 100 parts |
| Carbon black | 5 parts |
| Monoazo chromium complex type negative charge control agent | 2 parts |
| Wax A | 4 parts |

The above materials were premixed, and then melt-kneaded using a twin-screw kneading extruder set to 130° C. The kneaded product was cooled, and then crushed. Thereafter the crushed product was finely pulverized by means of a grinding mill using a jet stream, followed by classification using an air classifier to obtain toner particles (a toner) with a weight average particle diameter of 8 $\mu$m. Based on 100 parts by weight of the toner particles obtained, 1.0 part by weight of positively chargeable hydrophobic fine colloidal silica powder was externally added to obtain a toner. Based on 100 parts by weight of a ferrite carrier coated with styrene-acrylic resin and fluorine resin, 10 parts by weight of the toner 16 was blended to obtain a developer to be used as a base while further externally adding the toner as a supply.

Preparation of Toner 17

Toner 17 was prepared in the same manner as in Preparation of Toner 16 except that the non-linear polyester resin A was replaced with non-linear polyester resin A-1, and then also blended with the ferrite carrier to obtain a developer.

Preparation of Toner 18

Toner 18 was prepared in the same manner as in Preparation of Toner 16 except that the non-linear polyester resin A was replaced with non-linear polyester resin A-2, and then also blended with the ferrite carrier to obtain a developer.

Preparation of Toner 19

Toner 19 was prepared in the same manner as in Preparation of Toner 16 except that 100 parts by weight of the non-linear polyester resin A was replaced with 75 parts by weight of linear polyester resin B and 25 parts by weight of non-linear polyester resin A, and then also blended with the ferrite carrier to obtain a developer.

Preparation of Toner 20

Toner 20 was prepared in the same manner as in Preparation of Toner 16 except that 100 parts by weight of the non-linear polyester resin A was replaced with 75 parts by weight of linear polyester resin B-1 and 25 parts by weight of non-linear polyester resin A-1, and then also blended with the ferrite carrier to obtain a developer.

Preparation of Toner 21

Toner 21 was prepared in the same manner as in Preparation of Toner 16 except that 100 parts by weight of the non-linear polyester resin A was replaced with 75 parts by weight of linear polyester resin B-2 and 25 parts by weight of non-linear polyester resin A-2, and then also blended with the ferrite carrier to obtain a developer.

Preparation of Toner 22

Toner 22 was prepared in the same manner as in Preparation of Toner 16 except that 100 parts by weight of the non-linear polyester resin A was replaced with 75 parts by weight of linear polyester resin E and 25 parts by weight of non-linear polyester resin C, and then also blended with the ferrite carrier to obtain a developer.

Preparation of Toner 23

Toner 23 was prepared in the same manner as in Preparation of Toner 16 except that 100 parts by weight of the non-linear polyester resin A was replaced with 75 parts by weight of linear polyester resin E-1 and 25 parts by weight of non-linear polyester resin C-1, and then also blended with the ferrite carrier to obtain a developer.

Make-up of each toner is shown in Table 8.

TABLE 8

Make-up of Toner

| Toner | Binder resin (parts by weight) (Av: mg · KOH/g) | Whole binder resin acid value (mg · KOH/g) | Wax |
|---|---|---|---|
| 16 | Non-linear polyester resin A (100) (Av: 15) | 15 | A |
| 17 | Non-linear polyester resin A-1 (100) (Av: 8) | 8 | A |
| 18 | Non-linear polyester resin A-2 (100) (Av: 1) | 1 | A |

TABLE 8-continued

| Toner | Make-up of Toner: Binder resin (parts by weight) (Av: mg · KOH/g) | Whole binder resin acid value (mg · KOH/g) | Wax |
|---|---|---|---|
| 19 | Linear B (75)/Non-linear A (25) (Av: 12) (Av: 15) | 12.8 | A |
| 20 | Linear B-1 (75)/Non-linear A-1 (25) (Av: 7) (Av: 8) | 7.3 | A |
| 21 | Linear B-2 (75)/Non-linear A-2 (25) (Av: 2) (Av: 1) | 1.8 | A |
| 22 | Linear E (75)/Non-linear C (25) (Av: 12) (Av: 13) | 12.3 | A |
| 23 | Linear E-1 (75)/Non-linear C-1 (25) (Av: 3) (Av: 1.5) | 2.6 | A |

Example 1 and Comparative Examples 9A–13A

Using toners 16 to 23, the following fixing and offset test 3, blocking test and developing test were made.

Fixing and Offset Test 3

Unfixed images were formed on recording mediums using two-component type developers having the above toners 16 to 23, as developers for a commercially available electrophotographic copying machine NP-6650 (manufactured by Canon Inc.). Fixing and offset tests were made by fixing the unfixed toner images, using the external fixing device as shown in FIG. 5, comprising the pressure member 5 that stands opposite to the heater element 1 in pressure contact and brings the recording medium 6 into close contact with the heater element 1 interposing the film 2 between them. Used as a material of the fixing film 2 was an endless film comprising a polyimide film coated, in a thickness of 10 $\mu$m, with a release layer of a fluorine resin to which a conductive material was added. A silicone rubber was used for the pressure roller 5, and the fixing test was carried out with a nip of 3.5 mm, under a total pressure of 8 kg between the heater element 1 and the pressure roller 5, at a process speed of 50 mm/sec and under variable temperature control. The film was moved by the drive and tension between the drive roller 3 and the follower roller 4. Energy was pulsewise applied to the low heat capacity linear heater element 1 to control temperature.

In the test for low-temperature offset and fixing, paper of 80 g/m$^2$ was used. In the test for high-temperature offset, paper of 52 g/m$^2$ was used. To test the fixing performance, the fixed images were rubbed with Silbon paper, lens cleaning paper "DASPER" (trademark; Ozu Paper Co., Ltd.) under application of a load of 50 g/cm$^2$, and the temperature at which the rate of decrease in image density before and after the rubbing was less than 10% was regarded as the fixing starting temperature. With regard to the offset test, the temperature at which offset became no longer seen in visual observation was regarded as the low-temperature offset-free starting point, and, after the temperature was raised, the maximum temperature at which the offset no longer appeared was regarded as the offset-free end point. The test results are summarized in Table 9. In Table 9, the fixing starting temperature, rate of decrease in image density at 150° C., low-temperature offset-free point, high-temperature offset-free point, and non-offset temperature region are shown.

Blocking Test

About 20 g of developer was put in a 100 cc polyethylene cup and left standing at 50° C. for three days. Thereafter, blocking was visually evaluated. Results obtained are shown in Table 10.

Developing Test I

About 100 g of developer was put in a 500 cc polyethylene cup and left standing at 45° C. for three days. Thereafter, developing performance was evaluated on images formed after copying on 20 sheets using a commercially available electrophotographic copying machine NP-270Z (manufactured by Canon Inc.). The test results (image density and fog) are shown in Table 10. This test can be used for simulation to examine durability to in-machine temperature rise and storage stability in long-term leaving.

Developing Test II

About 100 g of developer was put in a 500 cc polyethylene cup and left standing at 32.5° C./85% Rh for three days. Thereafter, developing performance was evaluated on images formed on 1st sheet copying and 20th sheet copying using a commercially available electrophotographic copying machine NP-270Z (manufactured by Canon Inc.). The test results (image density and fog) are shown in Table 10. This test can be used for simulation to examine the rise of toner charging.

TABLE 9

| Fixing and Offset Test 3 | | | | | | |
|---|---|---|---|---|---|---|
| | | Fixing | | Non-offset Temp. Region | | |
| | Toner No. | Fixing start. temp. (° C.E) | Rate of density decrease (%) | Low-temp. starting point/A (° C.) | High-temp. starting point/B (° C.) | B - A (° C.) |
| Comparative Example: | | | | | | |
| 9A | 16 | 135 | 2 | 125 | 220 | 95 |
| 10A | 17 | 130 | 2 | 125 | 215 | 90 |
| 11A | 18 | 125 | 2 | 120 | 210 | 90 |
| 12A | 19 | 100 | 1 | 100 | 185 | 85 |
| 13A | 20 | 95 | 1 | 95 | 175 | 80 |
| Example: | | | | | | |
| 1 | 21 | 90 | 1 | 90 | 170 | 80 |
| Comparative Example: | | | | | | |
| 8 | 22 | 145 | 3 | 135 | 205 | 75 |
| 9 | 23 | 140 | 3 | 135 | 195 | 60 |

TABLE 10

Blocking Resistance and Developing Test

| Toner | | Blocking resistance | Developing performance I *2 | | Developing performance II *2 | | | |
|---|---|---|---|---|---|---|---|---|
| | | | | | 1st sheet | | 20th sheet | |
| | | | Image density | Fog | Image density | Fog | Image Density | Fog |
| Comparative Example: | | | | | | | | |
| 9A | Toner 16 | AA | 1.35 | AA | 1.24 | A | 1.33 | A |
| 10A | Toner 17 | AA | 1.37 | AA | 1.31 | A | 1.36 | AA |
| 11A | Toner 18 | AA | 1.37 | AA | 1.33 | AA | 1.36 | AA |
| 12A | Toner 19 | A | 1.34 | AA | 1.28 | A | 1.35 | AA |
| 13A | Toner 20 | A | 1.35 | A | 1.30 | AA | 1.34 | AA |
| Example: | | | | | | | | |
| 1 | Toner 21 | A | 1.35 | A | 1.34 | AA | 1.35 | AA |
| Comparative Example: | | | | | | | | |
| 8 | Toner 22 | B | 1.30 | A | 1.17 | B | 1.28 | A |
| 9 | Toner 23 | B | 1.32 | A | 1.23 | A | 1.28 | A |

*2 Evaluation criteria of blocking resistance (storage stability):
AA: Excellent; no agglomerates are seen.
A: Good; agglomerates are seen but can be broken up with ease.
B: Passable: agglomerates are seen, but can be broken up when shaken.

What is claimed is:

1. A negatively chargeable toner for developing electrostatic images, comprising (i) a binder resin, (ii) a wax (iii) a negative charge controlling agent and (iv) a magnetic material or a colorant, wherein:

(a) said binder resin contains as a primary component a polyester resin having a soft segment comprising an alkyl group having 5 to 30 carbon atoms or an alkenyl group having 5 to 30 carbon atoms, said polyester resin having the soft segment present in an amount not less than 50% by weight based on the weight of the binder resin;

said binder resin comprising a mixture of a non-linear polyester resin having said soft segment and a linear polyester resin;

said linear polyester resin having been obtained by polymerizing (i) a dicarboxylic acid and (ii) dihydric alcohols;

(b) said negative charge controlling agent has a compound selected from the group consisting of an acetylacetone metal complex, an aromatic hydroxycarboxylic acid metal complex, an aromatic dicarboxylic acid metal complex, an aromatic hydroxycarboxylic acid metal salt, an aromatic monocarboxylic acid metal salt, an aromatic polycarboxylic acid metal salt, phenol derivative and urea compound; and (c) said wax is a Fischer-Tropsch wax which has, in its endothermic peaks at the time of temperature rise and exothermic peaks at the time of temperature drop in a DSC curve measured using a differential scanning calorimeter, (i) an endothermic onset temperature within the range from 50° C. to 110° C., (ii) at least one endothermic peak P1 within the range from 70° C. to 130° C. at the time of temperature rise, and (iii) a maximum exothermic peak at the time of temperature drop, within the range of ±9° C. of the endothermic peak P1.

2. The toner according to claim 1, wherein said wax has (i) an endothermic onset temperature within the range of from 50° C. to 110° C., (ii) at least one endothermic peak P1 within the range of from 70° C. to 120° C. at the time of temperature rise, and (iii) a maximum exothermic peak at the time of temperature drop, within the range of ±7° C. of the endothermic peak P1.

3. The toner according to claim 1, wherein said wax has (i) an endothermic onset temperature within the range of from 60° C. to 90° C., (ii) at least one endothermic peak P1 within the range of from 95° C. to 120° C. at the time of temperature rise, and (iii) a maximum exothermic peak at the tame of temperature drop, within the range of ±5° C. of the endothermic peak P1.

4. The toner according to claim 1, wherein said wax has in its molecular weight distribution as measured by gel permeation chromatography a number average molecular weight Mn of from 300 to 1,500, a weight average molecular weight Mw of from 500 to 6,000 and Mw/Mn of not more than 3.0.

5. The toner according to claim 1, wherein said wax has in its molecular weight distribution as measured by gel permeation chromatography a number average molecular weight Mn of from 400 to 1,200, a weight average molecular weight Mw of 600 to 3,500 and Mw/Mn of not more than 2.5.

6. The toner according to claim 1, wherein said wax has in its molecular weight distribution as measured by gel permeation chromatography a number average molecular weight Mn of from 600 to 1,000, a weight average molecular weight Mw of from 600 to 3,500 and Mw/Mn of not more than 2.0.

7. The toner according to claim 1, wherein said wax is contained in the toner in an amount of not more than 20 parts by weight based on 100 parts by weight of the binder resin.

8. The toner according to claim 1, wherein said wax is contained in the toner in an amount of from 0.5 part by weight to 10 parts by weight based on 100 parts by weight of the binder resin.

9. The toner according to claim 1, wherein said polyester resin having a soft segment is obtained by synthesis using at least one monomer selected from the group consisting of an aliphatic dicarboxylic acid substituted with the soft segment and an aliphatic diol substituted with the soft segment.

10. The toner according to claim 9, wherein said aliphatic dicarboxylic acid substituted with the soft segment, said aliphatic diol substituted with the soft segment, or a combination thereof is contained in an amount of from 2 mole to 30 mol % with respect to all monomer components in the polyester resin.

11. The toner according to claim 9, wherein said aliphatic dicarboxylic acid substituted with the soft segment comprises at least one monomer selected from the group consisting of n-dodecenylsuccinic acid, n-dodecylsuccinic acid, indodecenylsuccinic acid, indodecylsuccinic acid, n-octenylsuccinic acid and n-octylsuccinic acid.

12. The toner according to claim 9, wherein said aliphatic diol substituted with the soft segment comprises at least one monomer selected from the group consisting of n-dodecenylethylene glycol and n-dodecenyltriethylene glycol.

13. The toner according to claim 1, wherein said nonlinear resin and said linear polyester resin are contained in the binder resin in a proportion of from 5:95 to 60:40, respectively.

14. The toner according to claim 1, wherein said nonlinear polyester resin and said linear polyester resin are contained in the binder resin in a proportion of from 10:90 to 40:60.

15. A heat fixing method comprising fixing a toner image on a recording medium by a heat fixing means wherein, said toner image is formed by a negatively chargeable toner having at least (i) a binder resin, (ii) a wax, (iii) negative charge controlling agent and (iv) a magnetic material or a colorant; wherein (a) said binder resin contains as a primary component a polyester resin having a soft segment comprising an alkyl group having 5 to 30 carbon atoms or an alkenyl group having 5 to 30 carbon atoms, said polyester resin having the soft segment present in an amount not less than 50% by weight based on the weight of the binder resin;

said binder resin comprising a mixture of a non-linear polyester resin having said soft segment and a linear polyester resin;

said linear polyester resin having been obtained by polymerizing (i) a dicarboxylic acid and (ii) dihydric alcohols;

(b) said negative charge controlling agent has a compound selected from the group consisting of an acetylacetone metal complex, an aromatic hydroxylcarboxylic acid metal complex, an aromatic dicarboxylic acid metal complex, an aromatic hydroxycarboxylic acid metal salt, an aromatic monocarboxylic acid metal salt, an aromatic polycarboxylic acid metal salt, phenol derivative and urea compound; and (c) said wax is a Fischer-Tropsch wax which has, in its endothermic peaks at the time of temperature rise and exothermic peaks at the time of temperature drop in a DSC curve measured using a differential scanning calorimeter, (i) an endothermic onset temperature within the range from 50° C. to 110° C., (ii) at least one endothermic peak P1 within the range from 70° C. to 130° C. at the time of temperature rise, and (iii) a maximum exothermic peak at the time of temperature drop, within the range of ±9° C. of the endothermic peak P1.

* * * * *

UNITED STATES PATENT AND TRADEMARK OFFICE

CERTIFICATE OF CORRECTION

PATENT NO. : 6,537,716 B1
DATED : March 25, 2003
INVENTOR(S) : Shinji Doi et al.

It is certified that error appears in the above-identified patent and that said Letters Patent is hereby corrected as shown below:

Title page,
Item [56], References Cited, FOREIGN PATENT DOCUMENTS,
"JP 57-52574 11/1982" should be deleted.

Column 1,
Line 25, "by fixing by fixing" should read -- by fixing --.

Column 10,
Line 48, "re presented" should read -- represented --.

Column 17,
Lines 8, 24, 39 and 54, "mg•/g." should read -- mg•KOH/g. --.

Column 18,
Lines 2, 26, 52 and 62, "mg•/g." should read -- mg•KOH/g. --.

Column 19,
Lines 4, 15 and 27, "mg•/g." should read -- mg•KOH/g. --; and
Line 40, "BISKOL" should read -- VISCOL --.

Column 20,
Line 14, "BISKOL" should read -- (VISCOL --.

Column 29,
Line 32, "wax" should read -- wax, --.

UNITED STATES PATENT AND TRADEMARK OFFICE

CERTIFICATE OF CORRECTION

PATENT NO. : 6,537,716 B1
DATED : March 25, 2003
INVENTOR(S) : Shinji Doi et al.

It is certified that error appears in the above-identified patent and that said Letters Patent is hereby corrected as shown below:

Column 30,
Line 39, “tame” should read -- time --.

Signed and Sealed this

Thirteenth Day of January, 2004

JON W. DUDAS
*Acting Director of the United States Patent and Trademark Office*